US010185239B2

(12) United States Patent
Tanaka et al.

(10) Patent No.: US 10,185,239 B2
(45) Date of Patent: Jan. 22, 2019

(54) IMAGE FORMING APPARATUS

(71) Applicant: CANON KABUSHIKI KAISHA, Tokyo (JP)

(72) Inventors: Takayuki Tanaka, Tokyo (JP); Shinji Katagiri, Yokohama (JP); Shuichi Tetsuno, Kawasaki (JP); Tsuguhiro Yoshida, Yokohama (JP); Takahiro Ikeda, Oyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 55 days.

(21) Appl. No.: 15/607,308

(22) Filed: May 26, 2017

(65) Prior Publication Data

US 2017/0343916 A1 Nov. 30, 2017

(30) Foreign Application Priority Data

May 31, 2016 (JP) ..... 2016-109283

(51) Int. Cl.
*G03G 15/01* (2006.01)
*G03G 15/04* (2006.01)
(Continued)

(52) U.S. Cl.
CPC ..... *G03G 15/0189* (2013.01); *G03G 15/0121* (2013.01); *G03G 15/0131* (2013.01); *G03G 15/0266* (2013.01); *G03G 15/04* (2013.01); *G03G 15/5041* (2013.01); *G03G 15/5054* (2013.01); *G03G 15/5058* (2013.01)

(58) Field of Classification Search
CPC ..... G03G 15/0121; G03G 15/0131; G03G 15/0189; G03G 15/0266; G03G 15/04; G03G 15/5041; G03G 15/5054; G03G 15/5058
See application file for complete search history.

(56) References Cited

U.S. PATENT DOCUMENTS

2005/0008404 A1* 1/2005 Tomizawa ..... G03G 15/168 399/297
2011/0158662 A1* 6/2011 Harashima ..... G03G 15/0844 399/27
(Continued)

FOREIGN PATENT DOCUMENTS

JP 2013-213992 A 10/2013
JP 2013-231806 A 11/2013

*Primary Examiner* — Francis C Gray
(74) *Attorney, Agent, or Firm* — Canon U.S.A., Inc. IP Division

(57) ABSTRACT

An exposing unit forms a latent-image electric potential on each photosensitive drum. A detecting toner image of each color is transferred to an intermediate transfer belt using a first potential difference between a latent-image electric potential and the potential of an intermediate transfer belt at each primary transfer portion. When the polarity of voltage to be applied from a transfer power source to a secondary transfer roller is to be switched to an opposite polarity while the detecting toner image of each color is passing through each primary transfer portion, the absolute value of a second potential difference between the potential of the intermediate transfer belt and the background electrical potential of each photosensitive drum is made equal to or greater than the absolute value of the first potential difference by a control unit.

22 Claims, 16 Drawing Sheets

(51) Int. Cl.
*G03G 15/00* (2006.01)
*G03G 15/02* (2006.01)

(56) References Cited

U.S. PATENT DOCUMENTS

2012/0027442 A1* 2/2012 Torimaru ..... G03G 15/161
399/44
2012/0045231 A1* 2/2012 Ogino ..... G03G 15/1675
399/45
2012/0243892 A1* 9/2012 Nakamura ..... G03G 15/1675
399/66
2014/0093261 A1* 4/2014 Ogata ..... G03G 15/5041
399/49
2015/0362866 A1* 12/2015 Matsushita ..... G03G 15/161
399/44

* cited by examiner

V (C) = CHARGE POTENTIAL

V (D) = BACKGROUND POTENTIAL

V (L) = LATENT-IMAGE POTENTIAL

V (C) = CHARGE POTENTIAL = BACKGROUND POTENTIAL

V (L) = LATENT-IMAGE POTENTIAL

V (C) = CHARGE POTENTIAL

V (D) = BACKGROUND POTENTIAL

V (L) = LATENT-IMAGE POTENTIAL

V (C) = CHARGE POTENTIAL

V (D) = BACKGROUND POTENTIAL

V (L) = LATENT-IMAGE POTENTIAL

V (C) = CHARGE POTENTIAL
V (D) = BACKGROUND POTENTIAL
V (L) = LATENT-IMAGE POTENTIAL
ΔV1 = FIRST POTENTIAL DIFFERENCE
ΔV2 = SECOND POTENTIAL DIFFERENCE
ΔV3 = THIRD POTENTIAL DIFFERENCE

IMAGE FORMING APPARATUS

BACKGROUND OF THE INVENTION

Field of the Invention

The present disclosure relates to an electrophotographic image forming apparatus, such as a laser printer, a copying machine, and a facsimile.

Description of the Related Art

There is a known electrophotographic color-image forming apparatus that employs an intermediate transfer system configuration in which image forming units for individual colors are independently disposed. In such an image forming apparatus, the image forming unit of each color includes a drum-shaped photosensitive member (hereinafter referred to as "photosensitive drum") serving as an image-bearing member and a primary transfer member at a position facing the corresponding photosensitive drum, with an intermediate transfer belt serving as an intermediate transfer member therebetween. With this configuration, voltage is applied from a primary transfer power source to the primary transfer member, so that a toner image formed on the photosensitive drum of each color is primarily transferred to the intermediate transfer belt at a primary transfer portion at which the photosensitive drum of each color and the intermediate transfer belt come into contact with each other. Subsequently, voltage is applied from a secondary transfer power source to a secondary transfer member, so that the toner images of individual colors are collectively secondarily transferred from the intermediate transfer belt to a transfer material, such as paper or an overhead projector (OHP) sheet, at a secondary transfer portion at which the secondary transfer member and the intermediate transfer belt come into contact with each other.

In the intermediate transfer type image forming apparatus, patch-like toner images (hereinafter referred to "detecting toner images" formed by the image forming units may be transferred to the intermediate transfer belt, and the image forming conditions may be adjusted depending on the result of detection of the toner images using a detecting sensor or the like. In the control for adjusting the image forming conditions, the detecting toner images are not transferred to a transfer material and are recovered by a toner recovery unit provided on the intermediate transfer belt or in the image forming units of individual colors after passing through the secondary transfer portion.

Japanese Patent Laid-Open. No. 2013-213992 discloses a configuration in which the detecting toner images are transferred to the intermediate transfer belt by applying voltage to the secondary transfer member to supply an electric current to the photosensitive drums of individual colors, and the polarity of the voltage to be applied to the secondary transfer member is switched before the detecting toner images reach the secondary transfer portion. Using such a configuration reduces or eliminates adhesion of the toner of the detecting toner images to the secondary transfer member when the detecting toner images pass through the secondary transfer portion.

The transfer of the detecting toner image from each photosensitive drum to the intermediate transfer belt is performed by forming a potential difference (hereinafter referred to as "first potential difference" between the detecting toner image carried by the photosensitive drum and the intermediate transfer belt at each image forming unit. However, with the configuration of Japanese Patent. Laid-Open No. 2013-213992, if the polarity of the voltage to be applied to the secondary transfer member is changed before the detecting toner image transferred at an upstream image forming unit finishes passing through a downstream image forming unit, the following problem can occur. That is, changing the voltage to be applied to the secondary transfer member also changes the potential of the intermediate transfer belt, possibly decreasing the potential difference (hereinafter referred to as "second potential difference") between the photosensitive drum of the downstream image forming unit and the intermediate transfer belt below the first potential difference.

When the detecting toner image transferred at the upstream image forming unit passes through the downstream image forming unit, with the second potential difference being less than the first potential difference, a potential difference for attracting the toner of the detecting toner image at the downstream image forming unit to the intermediate transfer belt can come short. This may reversely transfer part of the detecting toner image transferred at the upstream image forming unit from the intermediate transfer belt to the photosensitive drum in the downstream image forming unit (hereinafter the transfer of part of the toner image transferred at the upstream image forming unit to the photosensitive drum the downstream image forming unit is referred to as "reverse transfer").

SUMMARY OF THE INVENTION

The present disclosure prevents a decrease in the amount of toner of a detecting toner image due to reverse transfer in an image forming apparatus in which the potential of an intermediate transfer belt changes as the voltage to be applied to a secondary transfer member is switched.

An image forming apparatus according to an aspect of the present disclosure includes a first image-bearing member, a first exposing unit, a first developing unit, a second image-bearing member, an intermediate transfer belt, a secondary transfer member, a power source, a detecting unit, and a control unit. The first image-bearing member is configured to bear a toner image. The first exposing unit is configured to expose the first image-bearing member to form an electrostatic latent image. The first developing unit is configured to develop the electrostatic latent image formed on the first image-bearing member with toner to form a toner image. The second image-bearing member is configured to bear the toner image. The intermediate transfer belt is an endless and rotatable belt in contact with the first image-bearing member and the second image-bearing member. The secondary transfer member is configured to secondarily transfer the toner image that is primarily transferred from the first image-bearing member and the second image-bearing member to the intermediate transfer belt to a transfer material. The power source is configured to apply voltage to the secondary transfer member. The power source forms a first potential on the intermediate transfer belt by applying a voltage of a predetermined polarity to the secondary transfer member and forms a second potential different from the first potential on the intermediate transfer belt by applying a voltage having a polarity opposite to the voltage of the predetermined polarity to the secondary transfer member. The detecting unit is configured to detect a detecting toner image that is primarily transferred from the first image-bearing member and the second image-bearing member to the intermediate transfer belt. The detecting unit is disposed upstream from the secondary transfer member and downstream from the first image-bearing member and the second image-bearing member in a moving direction of the intermediate transfer belt. The second image-bearing member is disposed upstream from the detecting unit and downstream from the first image-bearing member. The first exposing unit exposes a position corresponding to an electrostatic latent image of the first detecting toner image to form a latent-image electric potential on the first image-bearing member, and the first developing unit develops the electrostatic latent image to form the first detecting toner image on the first image-bearing member. The control unit is configured to control the charging power source to form a potential of the second image-bearing member in such a manner that, in a case where a voltage having a polarity opposite to the voltage of the predetermined polarity is applied to the secondary transfer member while the first detecting toner image transferred to the intermediate transfer belt due to a first potential difference between the latent-image electric potential and the first potential is passing through a position at which the second image-bearing member and the intermediate transfer belt come into contact with each other, an absolute value of a second potential difference between the second potential and the potential of the second image-bearing member becomes equal to or greater than an absolute value of the first potential difference.

Further features of the present disclosure will become apparent from the following description of exemplary embodiments with reference to the attached drawings.

DESCRIPTION OF THE EMBODIMENTS

Embodiments of the present disclosure will be described hereinbelow with reference to the drawings. It is to be understood that the dimensions, materials, shapes, and relative positions of the components described in the following embodiments can be changed as appropriate according to the configurations of apparatuses that incorporate the present disclosure and various conditions and that the present disclosure is not limited to the embodiments.

First Embodiment

Configuration of Image Forming Apparatus

Figure 1:
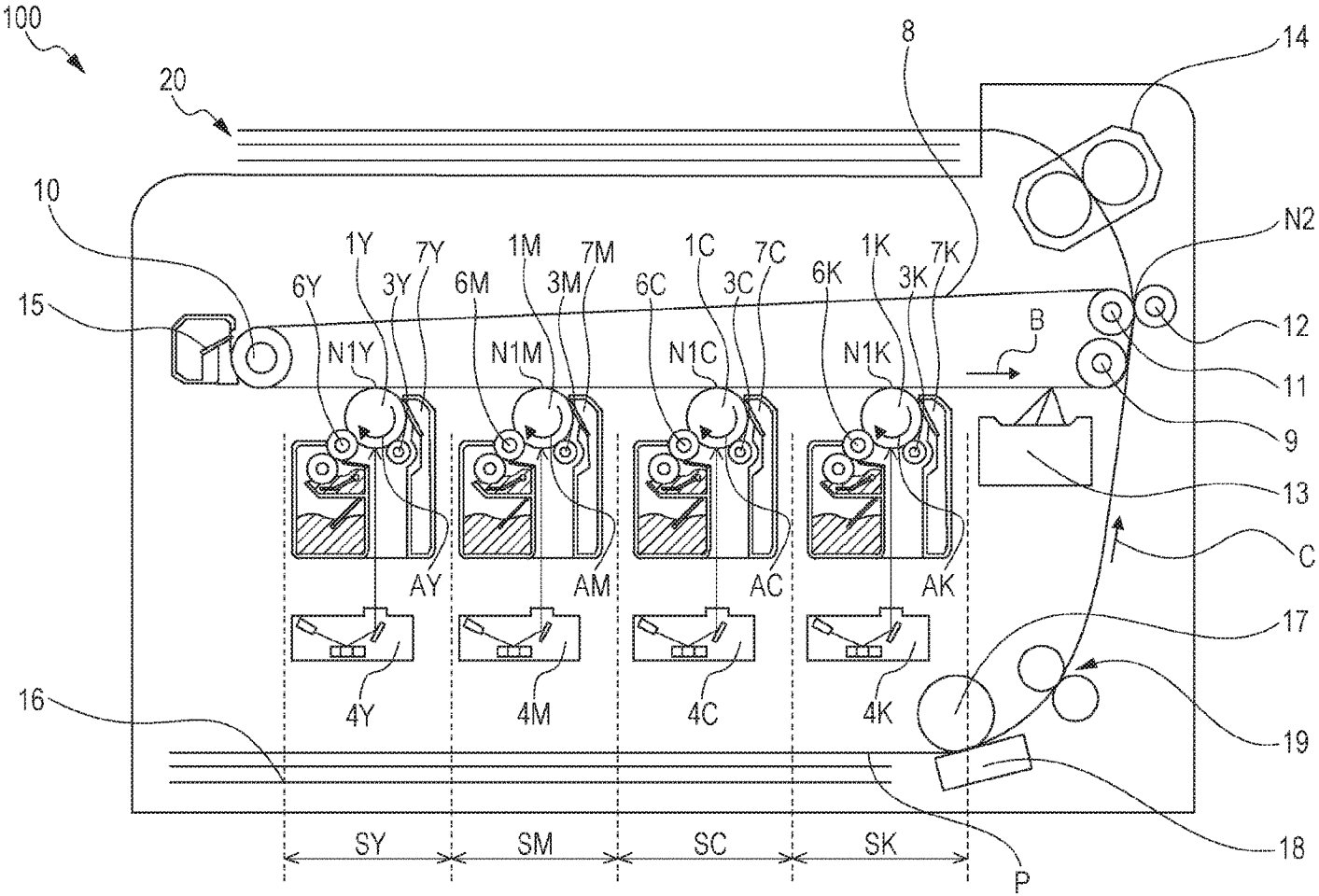
FIG. 1 is a schematic cross-sectional view of an image forming apparatus according to a first embodiment of the present disclosure.
Figure 2:
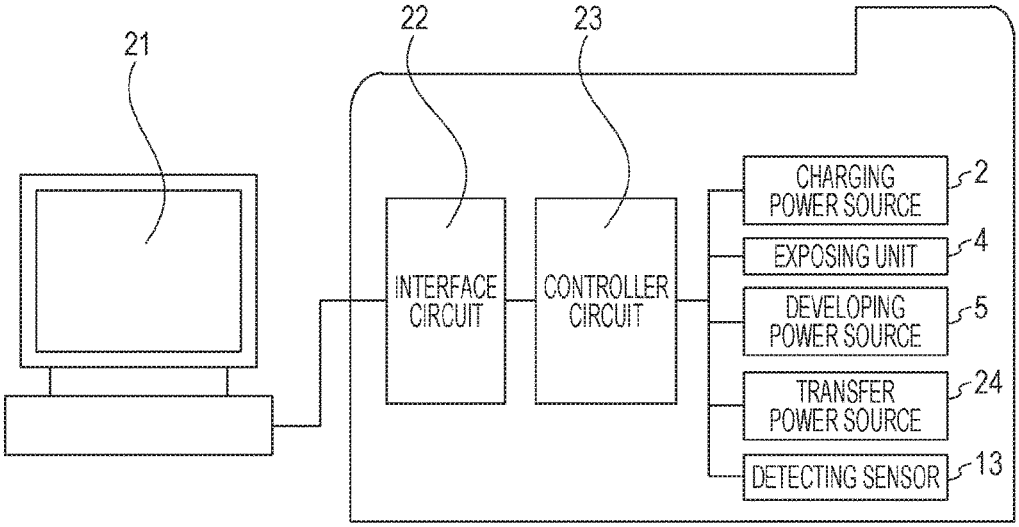
FIG. 2 is a block diagram of a control system for the image forming apparatus of the first embodiment.

FIG. 1 is a schematic cross-sectional view of an image forming apparatus 100 according to a first embodiment illustrating the configuration thereof. FIG. 2 is a block diagram of a control system for the image forming apparatus 100 of the present embodiment.

As illustrated in FIG. 2, the image forming apparatus 100 connects to a personal computer 21 which is a host computer. An operation start command and image signals from the personal computer 21 are transmitted to a controller circuit 23 serving as a control unit via an interface circuit 22 built in the image forming apparatus 100. The controller circuit 23 controls the various units, so that the image forming apparatus 100 executes image formation.

As illustrated in FIG. 1, the image forming apparatus 100 according to the present embodiment is a color-image forming apparatus in which image forming units SY, SM, SC, and SK that respectively form color images of yellow (Y), magenta (M), cyan (C), and black (K) are disposed at regular intervals. In the present embodiment, the configurations and operations of the image forming units SY, SM, SC, and SK are substantially the same except that the colors of images to be formed differ. Therefore, suffixes Y, M, C, and K attached to the signs to indicate the respective colors are omitted unless otherwise distinguished.

An image forming unit S includes a photosensitive drum 1 serving as an image-bearing member, a charging roller 3 serving as a charging unit, an exposing unit 4, a developing roller 6 serving as a developing unit, and a drum cleaning unit 7.

When an image forming operation is started, the photosensitive drum 1 is rotationally driven in the direction of arrow A in the drawing at a predetermined processing speed by receiving a driving force from a motor (not shown). Subsequently, the surface of the photosensitive drum 1 having a photoconductive layer is uniformly charged to negative polarity by the charging roller 3. A voltage is applied from a charging power source 2 to the charging roller 3 serving as a charging unit in the present embodiment, the respective charging rollers 3Y, 3M, 3C, and 3K of the image forming units SY, SM, SC, and SK are connected in common to the charging power source 2, the charge potentials of all the image forming units S are the same.

Next, the exposing unit 4 scans the surface of the photosensitive drum 1 for exposure to make the charge potential, which has become the same among all the image forming units S, to a potential according to the image forming conditions of the image forming unit S. At that time, the exposing unit 4 uniformly exposes the entire surface (background exposure) and exposes a position where a toner image is to be formed by a light amount that a signal based on image information indicates. As a result, the potential (latent-image electric potential) of an electrostatic latent image is formed at the position of the photosensitive drum 1 where the toner image is to be formed, and a uniform background electrical potential is formed at a position where no toner image is to be formed.

Toner charged to negative polarity is attached to the developing roller 6 serving as a developing unit which is disposed so as to come into or out of contact with the photosensitive drum 1. A voltage of a potential between the background electrical potential of the photosensitive drum 1 and the latent-image electric potential is applied from the developing power source 5 to the developing roller 6. This forms a potential difference between the developing roller 6 and the photosensitive drum 1, so that the developing roller 6 develops the electrostatic latent image formed on the photosensitive drum 1 using a toner to form a toner image on the surface of the photosensitive drum 1. Subsequently, the toner image formed on the photosensitive drum 1 is primarily transferred from the photosensitive drum 1 to an intermediate transfer belt 8 in the process of passing through a primary transfer portion. N1 at which the photosensitive drum 1 and the intermediate transfer belt 8 are in contact with each other. Toner remaining on the photosensitive drum 1 after the primary transfer is recovered by the drum cleaning unit 7.

The endless, rotatable intermediate transfer belt 8 is stretched round a drive roller 9, a stretching roller 10, and a secondary-transfer facing roller (hereinafter referred to as "facing roller") 11 and is moved in the direction of arrow B in the drawing by the drive roller 9 rotated by a driving force from a motor (not shown). As the intermediate transfer belt 8 moves, the toner image is primarily transferred from the photosensitive drum 1 to the intermediate transfer belt 8 in sequence at the primary transfer portion N1 of the image forming unit S, so that a toner image of a plurality of colors corresponding to a target color image is formed on the intermediate transfer belt 8.

In parallel with the image forming operation, a sheet feed roller 17 picks up one transfer material P from a sheet feed tray 16. One transfer material P is separated by friction with a separating pad 18, the skew of which is corrected by a registration roller pair 19, and is then conveyed in the direction of arrow C.

The toner image of a plurality of colors formed on the intermediate transfer belt 8 is conveyed to a secondary transfer portion N2 at which the facing roller 11 and a secondary transfer roller 12 face each other, with the intermediate transfer belt 8 therebetween, as the intermediate transfer belt 8 moves. At the secondary transfer portion N2, a secondary transfer voltage is applied from a transfer power source 24 to the secondary transfer roller 12, so that a potential difference is formed between the toner image of the plurality of colors born on the intermediate transfer belt 8 and the secondary transfer roller 12. This potential difference causes the toner image born on the intermediate transfer belt 8 to be secondarily transferred to the transfer material P conveyed to the secondary transfer portion N2. Thereafter, the transfer material P to which the toner image of the plurality of colors is secondarily transferred is conveyed to a fixing unit 14, where the toner image is fixed to the transfer material P by being pressed and heated, and is then discharged to an output tray 20.

Toner remaining on the intermediate transfer belt 8 after the secondary transfer is recovered by a belt cleaning unit 15. The belt cleaning unit 15 includes a rubber blade supported by a sheet metal. The belt cleaning unit 15 recovers the toner remaining on the intermediate transfer belt 8 by bringing the edge of the rubber blade into contact with the intermediate transfer belt 8.

In the image forming apparatus 100, the image forming units SY, SM, SC, and SK for respectively forming images of yellow (Y), magenta (M), cyan (C), and black (K) are disposed in a plane below the intermediate transfer belt 8 viewed from the direction of gravitational force. The configuration in which the image forming units S are disposed in a plane below the intermediate transfer belt 8 viewed from the direction of gravitational force is hereinafter referred to as "lower surface exposure system". In this system, the image forming units S are disposed at regular intervals, in which the distance between the primary transfer portions N1 of the image forming units S is equal, which is 60 mm in the present embodiment.

In the lower surface exposure system, the length of the intermediate transfer belt 8 from the lowermost primary transfer portion N1K to the secondary transfer portion N2 is smaller than the length of the intermediate transfer belt 8 from the uppermost primary transfer portion N1Y to the primary transfer portion N1K in the moving direction of the intermediate transfer belt 8. The length of the intermediate transfer belt 8 from the primary transfer portion N1K to the secondary transfer portion N2 in the present embodiment is 100 mm. This is smaller than the length, 60 mm×3=180 mm, of the intermediate transfer belt 8 from the primary transfer portion N1Y to the primary transfer portion N1K. Setting the distance from the primary transfer portion N1K of the lowermost image forming unit SK to the secondary transfer portion N2 in the moving direction of the intermediate transfer belt 8 small in this manner can decrease the time until a primarily transferred toner image is transferred to the transfer material P at the secondary transfer portion. N2 in the lower surface exposure system.

Configuration for Transfer

Figure 3:
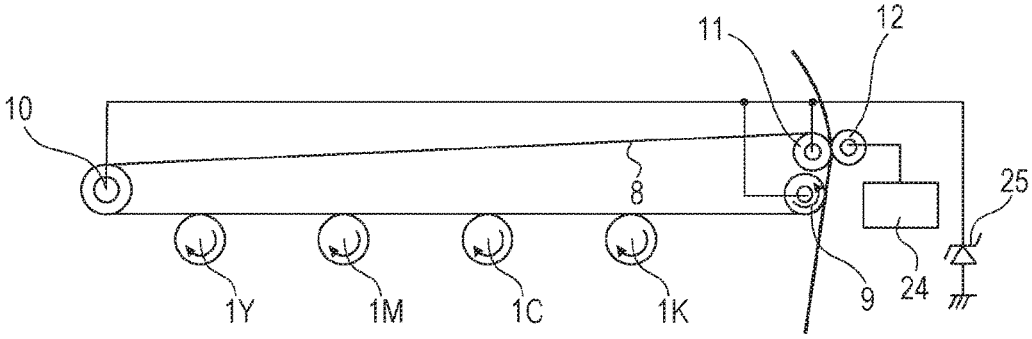
FIG. 3 is a schematic diagram illustrating the connection relationship among components in contact with an intermediate transfer belt, in the first embodiment.

Referring to FIG. 3, the configuration of transfer performed by the image forming apparatus 100 according to the present embodiment will be described. FIG. 3 is a schematic diagram illustrating the connection relationship among components in contact with the intermediate transfer belt 8 in the present embodiment.

The intermediate transfer belt 8 is an endless belt having electrical conductivity. When voltage is applied to part of the intermediate transfer belt 8, a current flows in the circumferential direction of the intermediate transfer belt 8. The transfer power source 24 is connected to the secondary transfer roller 12. The secondary transfer roller 12 is connected to the ground via the intermediate transfer belt 8, the facing roller 11, and a Zener diode 25 serving as a constant voltage element. The drive roller 9, the stretching roller 10, and the facing roller 11 serving as stretching members for stretching the intermediate transfer belt 8 are connected together at the same potential.

The Zener diode 25 serving as a constant voltage element is an element for keeping a predetermined voltage (hereinafter referred to as "breakdown voltage") when a current flows therethrough and generates a breakdown voltage on the cathode when a certain current or more flows. In the present embodiment, the Zener diode 25 is connected in the positive direction. In other words, the anode of the Zener diode 25 is connected to the ground, and the cathode is connected to the members (the drive roller 9, the stretching roller 10, and the facing roller 11) in contact with the inner circumferential surface of the intermediate transfer belt 8. As the Zener diode 25, a diode having a breakdown voltage of 300 V is used.

When the transfer power source 24 applies a voltage of predetermined polarity (positive polarity in the present embodiment) that is sufficiently larger than the breakdown voltage of the Zener diode 25 to the secondary transfer roller 12, the potential of the intermediate transfer belt 8 at the primary transfer portion N1 is maintained at the breakdown voltage of the Zener diode 25. In contrast, when the transfer power source 24 applies a voltage of negative polarity to the secondary transfer roller 12, the Zener diode 25 is connected in the forward direction, so that the potential of the intermediate transfer belt 8 at the primary transfer portion N1 becomes substantially 0 V.

In the present embodiment, the Zener diode 25 is used as a constant voltage element to stabilize the potential of the intermediate transfer belt 8. Alternatively, a varistor, which is another constant voltage element that provides the same effect, may be used. Another alternative is a resistive element that can maintain the potential of the intermediate transfer belt 8 at a predetermined potential or more. For example, a resistive element of about 50 MΩ to 100 MΩ may be connected instead of the Zener diode 25. When the resistive element is used, the potential of the intermediate transfer belt 8 varies according to the amount of current flowing through the resistive element, unlike the Zener diode 25.

Configuration of Sensor of Detecting Toner Image

Figure 4:
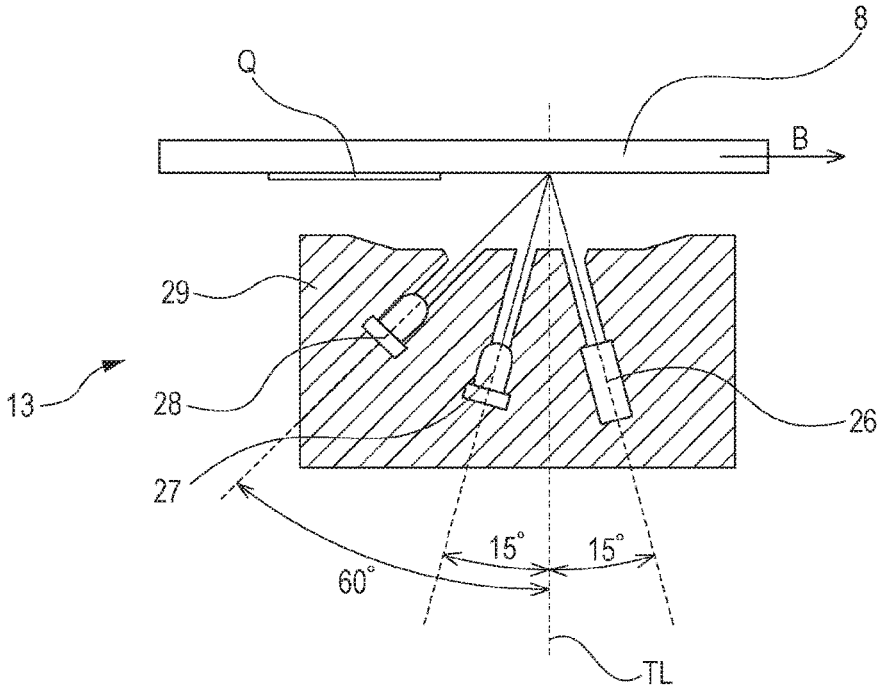
FIG. 4 is a schematic cross-sectional view of a sensor for detecting a detecting toner image in the first embodiment.

Referring next to FIG. 4, a detecting sensor 13 will be described. FIG. 4 is a schematic cross-sectional view of the detecting sensor 13 serving as a detecting unit for detecting a patch-like toner image (hereinafter referred to as "detecting toner image") transferred to the intermediate transfer belt 8. As illustrated in FIG. 1, the detecting sensor 13 is disposed between the lowermost image forming unit SK in the moving direction of the intermediate transfer belt 8 (the direction of arrow B in the drawing) and the secondary transfer roller 12 serving as a secondary transfer member and opposed to the outer circumferential surface of the intermediate transfer belt 8.

As illustrated in FIG. 4, the detecting sensor 13 has a configuration in which a light-emitting element 26, such as a light-emitting diode (LED), light-receiving elements 27 and 28, such as phototransistors, are fixed to a supporting member 29. The light-emitting element 26 is inclined at an angle of 15° with respect to a phantom line IL perpendicular to the intermediate transfer belt 8 and emits infrared rays (for example, with a wavelength of 950 nm) toward the surface of the intermediate transfer belt 8. The light-receiving element 27 is inclined at an angle of 15° with respect to the phantom line TL so as to be symmetrical with the light-emitting element 26 about the phantom line TL and receives specularly reflected light of the light applied to the surface of the intermediate transfer belt 8 from the light-emitting element 26. The light-receiving element 28 is disposed upstream from the light-receiving element 27 in the moving direction of the intermediate transfer belt 8 (the direction of arrow B in the drawing) at an angle of 60° with respect to the phantom line TL and receives the diffused reflected light of the light applied to the surface of the intermediate transfer belt 8 from the light-emitting element 26.

A detecting toner image Q formed on the intermediate transfer belt 8 moves with the rotation of the intermediate transfer belt 8 to pass through the detection region of the detecting sensor 13. The detecting toner image Q and the surface of the intermediate transfer belt 8 reflect the infrared rays emitted from the light-emitting element 26. Of the reflected light, specularly reflected light is received by the light-receiving element 27, and diffused reflected light is received by the light-receiving element 28. By computing the output of the reflected light received by the light-receiving element 27 and the light-receiving element 28, it is possible to calculate the amount of the toner of the detecting toner image Q on the intermediate transfer belt 8.

Operation for Adjusting Image Density

An image formed by the image forming apparatus 100 changes according to changes in surrounding environment, secular changes of the image forming apparatus, etc. For that reason, image forming conditions, such as image density and an image forming position, are adjusted at the timing satisfying specified conditions. An operation for adjusting the image density will be described with reference to FIGS. 5 and 6 and FIGS. 7A to 7D. The specified conditions include power-on, changes in temperature or humidity, a lapse of a fixed time, and the number of prints.

In the operation for adjusting the image density, first, control similar to that of normal image forming operation is performed to form a detecting toner image Q of each color on the intermediate transfer belt 8 from the photosensitive drum 1 of the image forming unit S. Subsequently, the amount of the toner of the detecting toner image Q is measured by the detecting sensor 13, and the measurement result is incorporated into the controller circuit 23. According to the measurement result, the controller circuit 23 changes the control parameters of each unit with reference to a look-up table (LUT) stored in advance in a built-in memory. Through these operations, the image density is adjusted.

Figure 5:
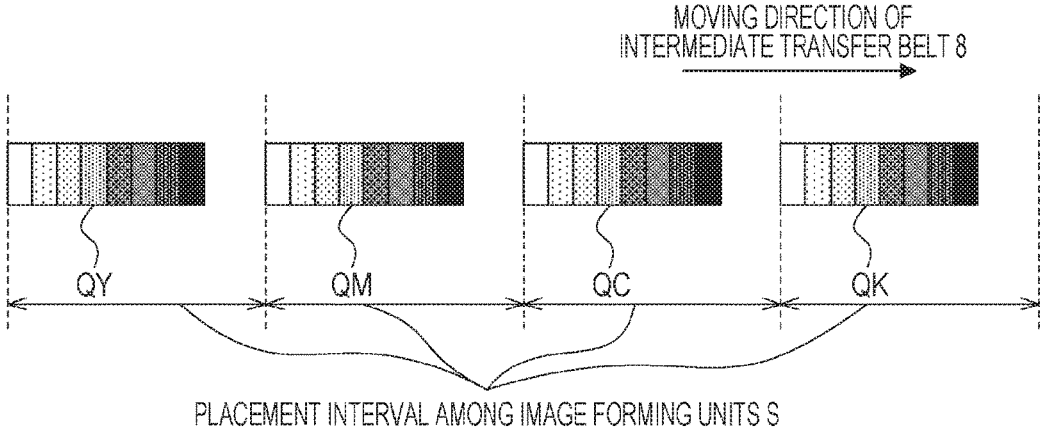
FIG. 5 is a diagram illustrating detecting toner images for use in adjusting the image density in the first embodiment.

FIG. 5 is a diagram illustrating the detecting toner images Q for use in adjusting the image density. As illustrated in FIG. 5, the detecting toner images Q of the individual colors for use in adjusting the image density are arranged in the order of detecting toner images QK, QC, QM, and QY from the downstream side in the moving direction of the intermediate transfer belt 8. Each detecting toner image Q is constituted by an eight gradation pattern. The detecting toner images Q of the individual colors are disposed at regular intervals. The length of each detecting toner image Q is smaller than the distance between the adjacent image forming units S. In the present embodiment, the detecting toner images Q of the individual colors are transferred from the individual image forming unit S to the intermediate transfer belt 8 at the same time.

Figure 6:
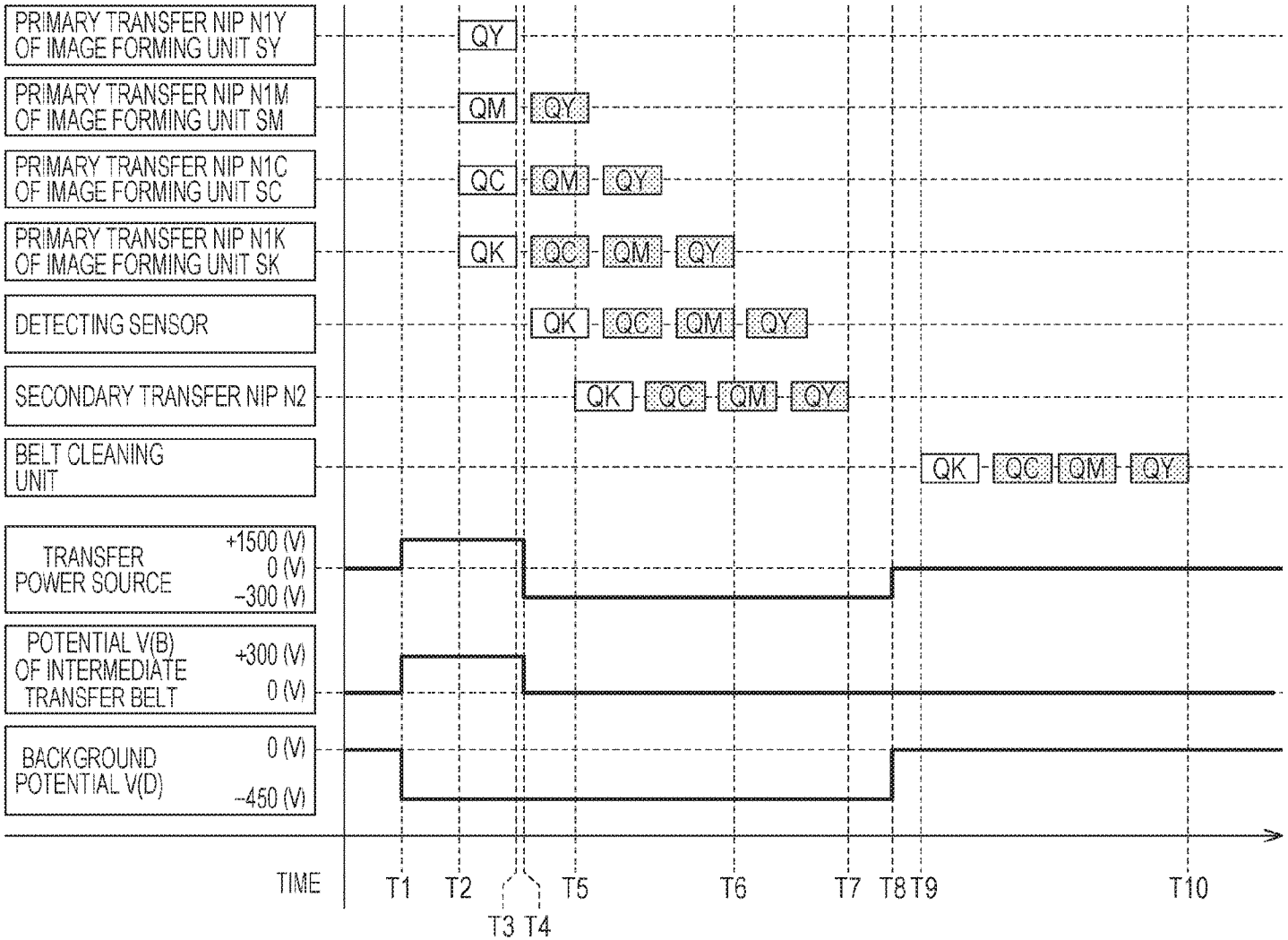
FIG. 6 is a sequence diagram of an operation for adjusting the image density in the first embodiment.

FIG. 6 is a sequence diagram of the operation for adjusting the image density in the present embodiment. FIGS. 7A to 7D are schematic diagrams illustrating the positions of the detecting toner images Q of the individual colors on the intermediate transfer belt 8.

As illustrated in FIG. 6, time T1 is the time when the controller circuit 23 of the image forming apparatus 100 starts the operation for adjusting the image density. At that time, the controller circuit 23 controls the charging power source 2 and each exposing unit 4, so that each photosensitive drum 1 is charged to −800 V and is then exposed by each exposing unit 4. This causes a latent-image electric potential V(L) to be formed at a position of each photosensitive drum 1 where the detecting toner image Q is born, and a background electrical potential V (D) to be formed on the other portion. In the present embodiment, the latent-image electric potential V(L) is set to −100 V, and the background electrical potential V (D) is set to −450 V.

Furthermore, at time T1, a voltage of 1,500 V is applied from the transfer power source 24 to the secondary transfer roller 12, so that the potential of the intermediate transfer belt 8 is maintained at 300 V (first potential), which is the breakdown voltage of the Zener diode 25. In other words, the potential of the intermediate transfer belt 8 corresponding to the position of each primary transfer portion N1 becomes 300 V. Furthermore, at time T1, each developing roller 6 is brought into contact with each photosensitive drum 1, so that the detecting toner image Q is developed on the photosensitive drum 1.

Figure 7A:
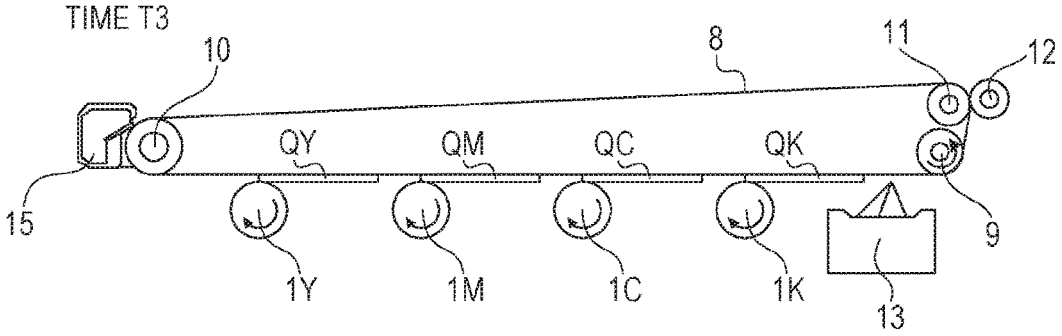
FIGS. 7A to 7D are schematic diagrams illustrating the positions of the detecting toner images at different times at the operation for adjusting the image density in the first embodiment.

The time T2 is the time when each detecting toner image Q formed on each photosensitive drum 1 reaches each primary transfer portion N1 and is transferred from the photosensitive drum 1 to the intermediate transfer belt 8. At that time, each detecting toner image Q is transferred at each primary transfer portion N1 to the intermediate transfer belt 8 because of the potential difference (first potential difference ΔV1) between the latent-image electric potential V(L) and the potential of the intermediate transfer belt 8. Then, as illustrated in FIG. 7A, at time 14, the transfer of the detecting toner image Q of each color to the intermediate transfer belt 8 is completed.

Figure 7B:
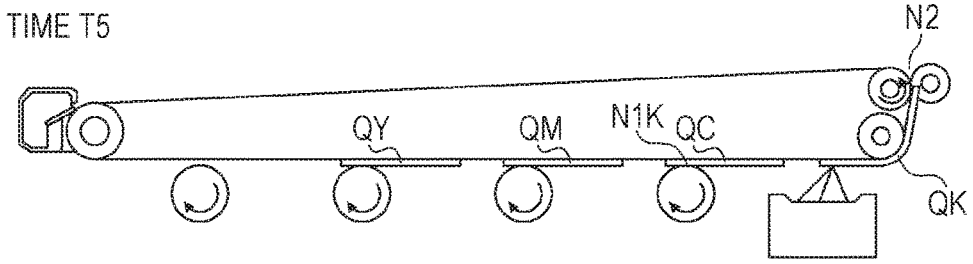
Figure 7C:
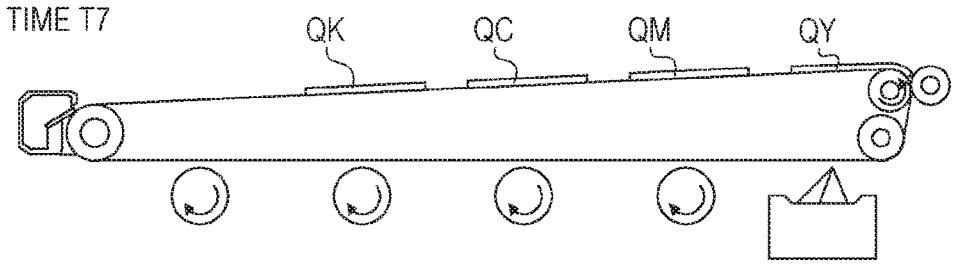
Figure 7D:
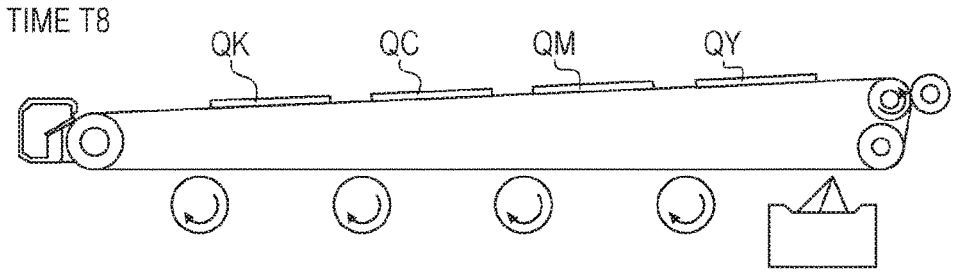

As illustrated in FIG. 7B, time T5 is the time when the leading end of the detecting toner image QK enters the secondary transfer portion N2. Here, in the operation for adjusting the image density, the detecting toner image Q transferred to the intermediate transfer belt 8 is not secondarily transferred to the transfer material P, unlike the normal image forming operation. Therefore, if the output of the transfer power source 24 is kept at 1,500 V at time T5, toner of the detecting toner image QK charged to negative polarity adheres to the secondary transfer roller 12 by the force of an electric field directed from the intermediate transfer belt 8 toward the secondary transfer roller 12. When the toner adheres to the secondary transfer roller 12, the toner can adhere to the back surface of the transfer material P while the transfer material P is being conveyed to the secondary transfer portion N2 in the next normal image forming operation.

For that reason, in the present embodiment, to prevent the toner from adhering to the secondary transfer roller 12, the output of the transfer power source 24 is switched to −300 V before the leading end of the detecting toner image QK reaches the secondary transfer portion N2 at time T5. Since the Zener diode 25 is connected in the positive direction, application of voltage of negative polarity from the transfer power source 24 to the secondary transfer roller 12 makes the potential of the intermediate transfer belt 8 substantially 0 V (second potential). This prevents the toner of the detecting toner image QK charged to negative polarity from adhering to the secondary transfer roller 12 due to the force of the electric field from the secondary transfer roller 12 toward the intermediate transfer belt 8.

The timing when the polarity of the voltage to be applied from the transfer power source 24 to the secondary transfer roller 12 is switched from positive polarity to negative polarity may be time T4 between time T3 and time T5. This is because, if the polarity of the voltage to be output from the transfer power source 24 is changed before time T3, the transfer of each detecting toner image Q to the intermediate transfer belt 8 may not have been completed.

In the present embodiment, a uniform background electrical potential V(D2) is formed on the surface of each photosensitive drum 1 by controlling the exposure amount of each exposing unit 4 using the controller circuit 23 after the polarity of the voltage to be output from the transfer power source 24 is changed. The exposure amount of each exposing unit 4 is controlled so that the absolute value of the potential difference (second potential difference ΔV2) between the potential of the intermediate transfer belt 8 after the polarity of the voltage to be applied from the transfer power source 24 to the secondary transfer roller 12 is changed and the background electrical potential V(D2) is equal to or greater than the absolute value of the first potential difference ΔV1. In the present embodiment, each photosensitive drum 1 is irradiated with light having a light amount by each exposing unit 4 so that the background electrical potential V(D2) of each photosensitive drum 1 is −500 V.

In other words, in the present embodiment, the polarity of voltage to be output from the transfer power source 24 is changed, and the amount of light of background exposure of each photosensitive drum 1 from each exposing unit 4 is decreased. Thus, the background electrical potential. V(D2) such that the absolute value of the second potential difference ΔV2 is equal to or greater than the absolute value of the first potential difference ΔV1 is formed on each photosensitive drum 1. The control for setting the background electrical potential V(D2) of each photosensitive drum 1 to −500 V may be performed at the same time as or after the switching of the polarity of the voltage to be applied from the transfer power source 24 to the secondary transfer roller 12. If the background electrical potential V(D2) of each photosensitive drum 1 changes before the polarity of the voltage to be output from the transfer power source 24 is switched, the second potential difference ΔV2 can temporarily increase to cause electric discharge from each photosensitive drum 1.

Furthermore, when the background electrical potential V(D2) of each photosensitive drum 1 is changed to −500 V, the potential difference between each photosensitive drum 1 and each developing roller 6 increases. If the potential difference between each photosensitive drum 1 and each developing roller 6 becomes too large, toner can unnecessarily adhere to the non-exposed portion of each photosensitive drum 1. To prevent it, each developing roller 6 may be separated from each photosensitive drum 1 before the background electrical potential V(D2) of the photosensitive drum 1 is changed. In the present embodiment, each developing roller 6 is separated from each photosensitive drum 1 at time T4, as illustrated in FIG. 6.

Another method for preventing the potential difference between each photosensitive drum 1 and each developing roller 6 from becoming too large is to change the potential of each developing roller 6 when the background electrical potential V(D2) of each photosensitive drum 1 is changed. In this case, the developing power source 5 that applies voltage to each developing roller 6 is controlled by the controller circuit 23 to change the potential of each developing roller 6 so that the absolute value of the potential difference between each photosensitive drum 1 and each developing roller 6 decreases. The change in the potential of each developing roller 6 may be performed at the same time as or after the change in the background electrical potential V(D2) of each photosensitive drum 1. If the potential of each developing roller 6 is changed before the background electrical potential V(D2) of each photosensitive drum 1 is changed, the potential difference between each photosensitive drum 1 and each developing roller 6 is temporarily decreased, possibly causing adhesion of toner to the portion of each photosensitive drum 1 at the background electrical potential V(D2).

The detecting toner images Q of the individual colors transferred to the intermediate transfer belt 8 are detected by the detecting sensor 13 while sequentially passing a position facing the detecting sensor 13 as the intermediate transfer belt 8 moves, and the detection results of the amounts of toner of the level of gray are input to the controller circuit 23. The controller circuit 23 changes the control parameters of each unit on the bases of the results of detection of the toner amount performed by the detecting sensor 13.

Time T6 is the time when the trailing end of the detecting toner image QY passes through the primary transfer portion N1K of the lowermost image forming unit SK. At time T6, all of the detecting toner images Q complete passing through the primary transfer portion N2K. After time T6 onward, the operation in each image forming unit S may be stopped.

Time T7 is the time when the trailing end of the detecting toner image QY passes through the secondary transfer portion N2. At time T7, all of the detecting toner images Q complete passing through the secondary transfer portion N2. After time T7 onward, the application of voltage from the transfer power source 24 to the secondary transfer roller 12 may be stopped. In the present embodiment, at time T8, the operation of each image forming unit S and the application of voltage from the transfer power source 24 to the secondary transfer roller 12 are stopped.

Subsequently, each detecting toner image Q moves together with the intermediate transfer belt 8 and is recovered by the belt cleaning unit 15 between time T9 and time T10. The operation for adjusting the image density is completed at time T10 at which the belt cleaning unit 15 completes recovery of all the detecting toner images Q, and the image forming apparatus 100 shifts to a halted state.

After time T7 at which all the detecting toner images Q have passed through the secondary transfer portion N2, the next image density adjusting operation or normal image forming operation may be started. In this case, at time T8, the voltage to be applied from the transfer power source 24 to the secondary transfer roller 12 may be returned to 1,500 V, and the next operation may be performed.

Operation and Advantages of Present Embodiment

The operation and advantages of the present embodiment will be described in detail herein below mainly using the image forming unit SC and the image forming unit SK. The detecting sensor 13 serving as a detecting unit is disposed upstream from the secondary transfer roller 12 serving as a secondary transfer member and downstream from the photosensitive drum 1C (first image-bearing member) and the photosensitive drum 1K (second image-bearing member) in the moving direction of the intermediate transfer belt 8. The photosensitive drum 1K is upstream from the detecting sensor 13 and downstream from the photosensitive drum 1C in the moving direction of the intermediate transfer belt 8. The photosensitive drum 1K is disposed on the lowermost stream side in the moving direction of the intermediate transfer belt 8, and the photosensitive drum 1Y (third image-bearing member) is disposed on the uppermost stream side.

As illustrated in FIG. 7B, at time T5 at which the detecting toner image QK (second detecting toner image) reaches the secondary transfer portion N2, part of the detecting toner image QC (first detecting toner image) has not passed through the primary transfer portion N1K. In other words, the detecting toner image QC that, is transferred to the intermediate transfer belt 8 in the image forming unit SC upstream from the image forming unit SK has to pass through the primary transfer portion N1K after the polarity of the voltage to be applied from the transfer power source 24 to the secondary transfer roller 12 is switched.

Figure 8A:
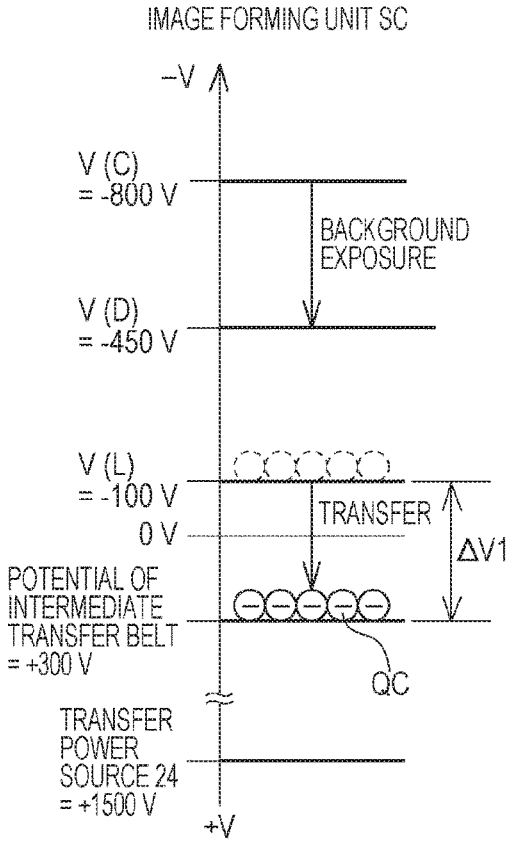
FIG. 8A is a schematic diagram illustrating the potential relationship at the operation for adjusting the image density in the first embodiment.
Figure 8B:
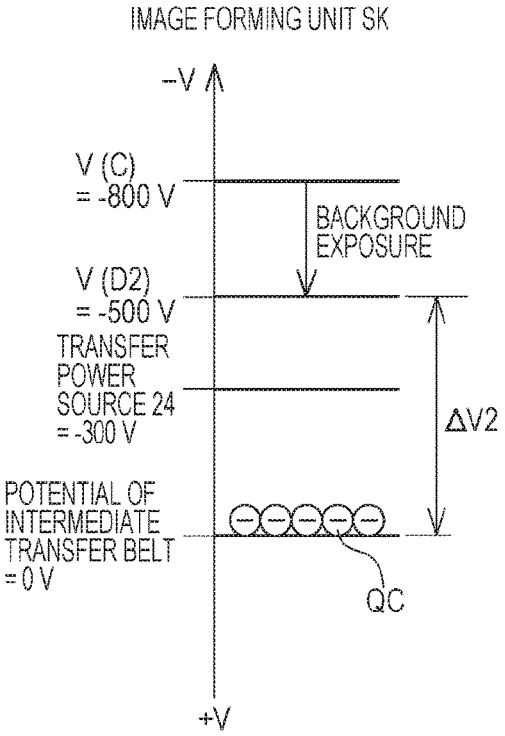
FIG. 8B is a schematic diagram illustrating the potential relationship at the operation for adjusting the image density in the first embodiment.

FIG. 8A is a schematic diagram illustrating the potential relationship when the detecting toner image QC is transferred to the intermediate transfer belt 8 during time T2 to time T3. At that time, the absolute value of the first potential difference ΔV1 for transferring the detecting toner image QC to the intermediate transfer belt 8 is 400 V. FIG. 8B is a schematic diagram illustrating the potential relationship when the polarity of the voltage to be applied from the transfer power source 24 to the secondary transfer roller 12 is switched when the detecting toner image QC transferred to the intermediate transfer belt 8 passes through the primary transfer portion N1K.

In the present embodiment, after the detecting toner image QK is transferred from the photosensitive drum 1K to the intermediate transfer belt 8, the controller circuit 23 controls the exposing unit 4K to form the background electrical potential V(D2) on the surface of the photosensitive drum 1K. At that time, the background electrical potential V(D2) is set so that the absolute value of the second potential difference ΔV2 becomes equal to or greater than the absolute value of the first potential difference ΔV1. The absolute value of the second potential difference ΔV2 in the present embodiment is 500 V. Thus, a potential difference that allows the detecting toner image QC transferred to the intermediate transfer belt 8 to be attracted to the intermediate transfer belt 8 is formed at the primary transfer portion N1K. This reduces or eliminates the reversely transfer of the detecting toner image QC from the intermediate transfer belt 8 to the photosensitive drum 1K (hereinafter referred to as "reverse transfer").

In the present embodiment, the amount of toner reversely transferred from the detecting toner image QC transferred to the intermediate transfer belt 8 to the photosensitive drum 1K is measured using the following method. First, the detecting toner image QC with a charge amount of 35 μC/g and a toner amount of 0.45 mg/cm$^2$ per unit area is formed on the intermediate transfer belt 8. The polarity of voltage to be applied from the transfer power source 24 to the secondary transfer roller 12 is switched when this detecting toner image QC reaches the primary transfer portion N1K of the image forming unit SK, and the detecting toner image QC is passed through the primary transfer portion N1K. Subsequently, the amount of toner adhering to the photosensitive drum 1K is measured as a reflection density.

The reflection density is measured using a GretagMachbeth spectrodensitometer X-Rite 504 by collecting the toner adhering to the photosensitive drum 1K using a polyester tape and bonding the polyester tape after the collection to high-quality paper. A polyester tape that is not used to collect toner and bonded to high-quality paper is also used for measurement. The difference between them is determined as the amount of toner adhering to the photosensitive drum 1K by reverse transfer. The toner used in the present embodiment is spherical resin particles with a volume mean particle diameter of about 6.5 μm on which silicon oxide particles of about 20 nm and about 1.5% of the weight of the toner are uniformly attached.

Figure 9:
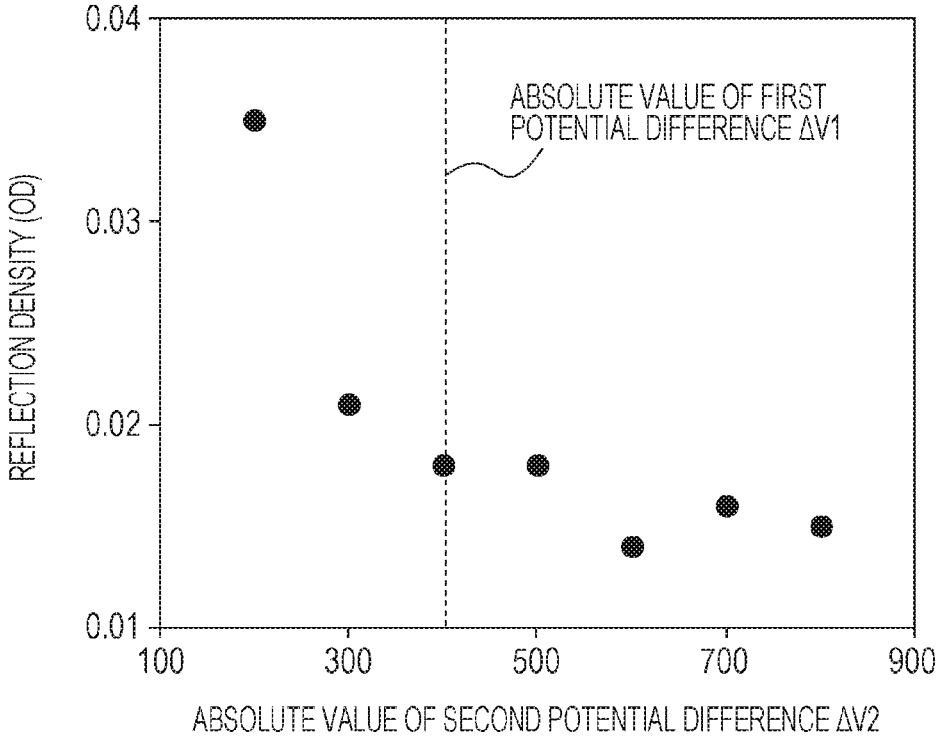
FIG. 9 is a table illustrating the results of measurement of the amount of reversely transferred toner in the first embodiment.

FIG. 9 is a table illustrating the relationship between the reflection density measured using the above method and the absolute value of the second potential difference ΔV2. As illustrated in FIG. 9, the value of the reflection density is great in the case where the absolute value of the second potential difference ΔV2 is smaller than the absolute value of the first potential difference ΔV1, and the value of the reflection density is small in the case where the absolute value of the second potential difference ΔV2 is greater than the absolute value of the first potential difference ΔV1.

In the present embodiment, the background electrical potential V(D2) at which the absolute value of the second potential difference ΔV2 is 500 V is set so that the detecting toner image QC transferred to the intermediate transfer belt 8 can be more attracted to the intermediate transfer belt 8. However, as illustrated in FIG. 9, when the absolute value of the second potential difference ΔV2 is equal to or greater than the absolute value of the first potential difference ΔV1, reverse transfer can be reduced or eliminated in the configuration of the present embodiment.

Another conceivable configuration for reducing or eliminating reverse transfer without using the configuration of the present embodiment is a configuration in which the detecting toner image Q of each color is transferred from each photosensitive drum 1 to the intermediate transfer belt 8 and then each photosensitive drum 1 and the intermediate transfer belt 8 are separated from each other. This allows each primary transfer portion N1 to be temporarily dissolved, preventing the detecting toner image Q of each color from being reversely transferred from the intermediate transfer belt 8 to each photosensitive drum 1. However, such a configuration needs a new mechanism for separating each photosensitive drum 1 and the intermediate transfer belt 8 from each other. Furthermore, this configuration needs to control the timing when each photosensitive drum 1 and the intermediate transfer belt 8 are separated after each detecting toner image Q is transferred, complicating the configuration more than that of the present embodiment.

In the present embodiment, the detecting toner images Q of the individual colors are transferred from the respective photosensitive drums 1 to the intermediate transfer belt 8 at the same time. This is not intended to limit the present disclosure. The detecting toner image Q may be transferred from only part of the photosensitive drums 1 to the intermediate transfer belt 8. The detecting toner images Q of the individual colors may be transferred from the photosensitive drums 1 to the intermediate transfer belt 8 at different timings.

Although the present embodiment has been described using the image-density adjusting operation as an example, similar advantages can be obtained using the configuration of the present embodiment also for the adjusting operation of detecting the positions of detecting toner images transferred to the intermediate transfer belt 8 and correcting the deviation of toner images at image formation.

Furthermore, in the present embodiment, the amount of exposure from each exposing unit 4 to each photosensitive drum 1 is controlled by the controller circuit 23 serving as a control unit to form the background electrical potential V(D2) at which the absolute value of the second potential ΔV 2 is equal to or greater than the absolute value of the first potential difference ΔV1. However, this is not intended to limit the present disclosure. It is also possible to form the background electrical potential V(D2) at which the absolute value of the second potential difference ΔV2 is equal to or greater than the absolute value of the first potential difference ΔV1 on each photosensitive drum 1 by controlling the charging power source 2 using the controller circuit 23. Likewise, it is also possible to form the background electrical potential V(D2) at which the absolute value of the second potential difference ΔV2 is equal to or greater than the absolute value of the first potential difference ΔV1 on each photosensitive drum 1 by controlling both of the charging power source 2 and the exposing unit 4 using the controller circuit 23. The following is Modification 1 of the present embodiment with a configuration for reducing or eliminating reverse transfer by controlling the charging power source 2 using the controller circuit 23.

Figure 10A:
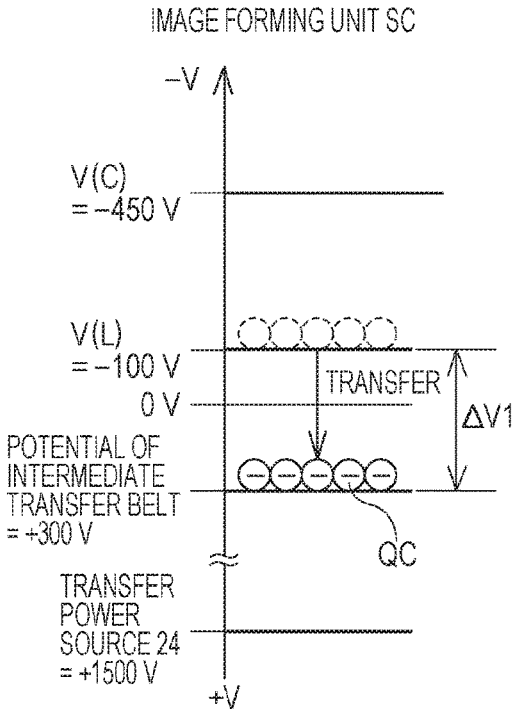
FIG. 10A is a schematic diagram illustrating the potential relationship at the operation for adjusting the image density in Modification 1.
Figure 10B:
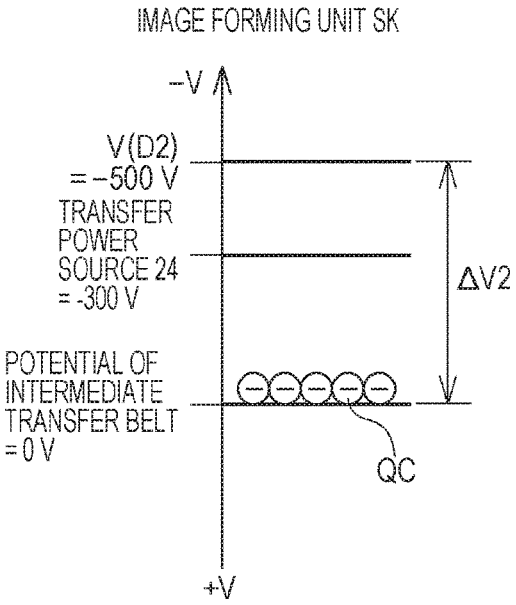
FIG. 10B is a schematic diagram illustrating the potential relationship at the operation for adjusting the image density in Modification 1.

FIG. 10A is a schematic diagram illustrating the potential relationship when the detecting toner image QC is transferred to the intermediate transfer belt 8 in Modification 1 of the present embodiment. FIG. 10B is a schematic diagram illustrating the potential relationship when the polarity of voltage to be applied from the transfer power source 24 to the secondary transfer roller 12 is switched when the detecting toner image QC transferred to the intermediate transfer belt 8 passes through the primary transfer portion N1K.

As illustrated in FIG. 10A, in Modification 1, each exposing unit 4 does not perform background exposure but performs exposure using only light with a light amount indicated by a signal based on image information to form a latent-image electric potential V(L) on the surface of each photosensitive drum 1. As illustrated in FIG. 10B, the background electrical potential (D2) at which the absolute value of the second potential difference ΔV2 is equal to or greater than the absolute value of the first potential difference ΔV1 is formed on the photosensitive drum 1K by controlling the charging power source 2 using the controller circuit 23. Thus, Modification 1 also has the same advantages as those of the present embodiment.

Figure 11:
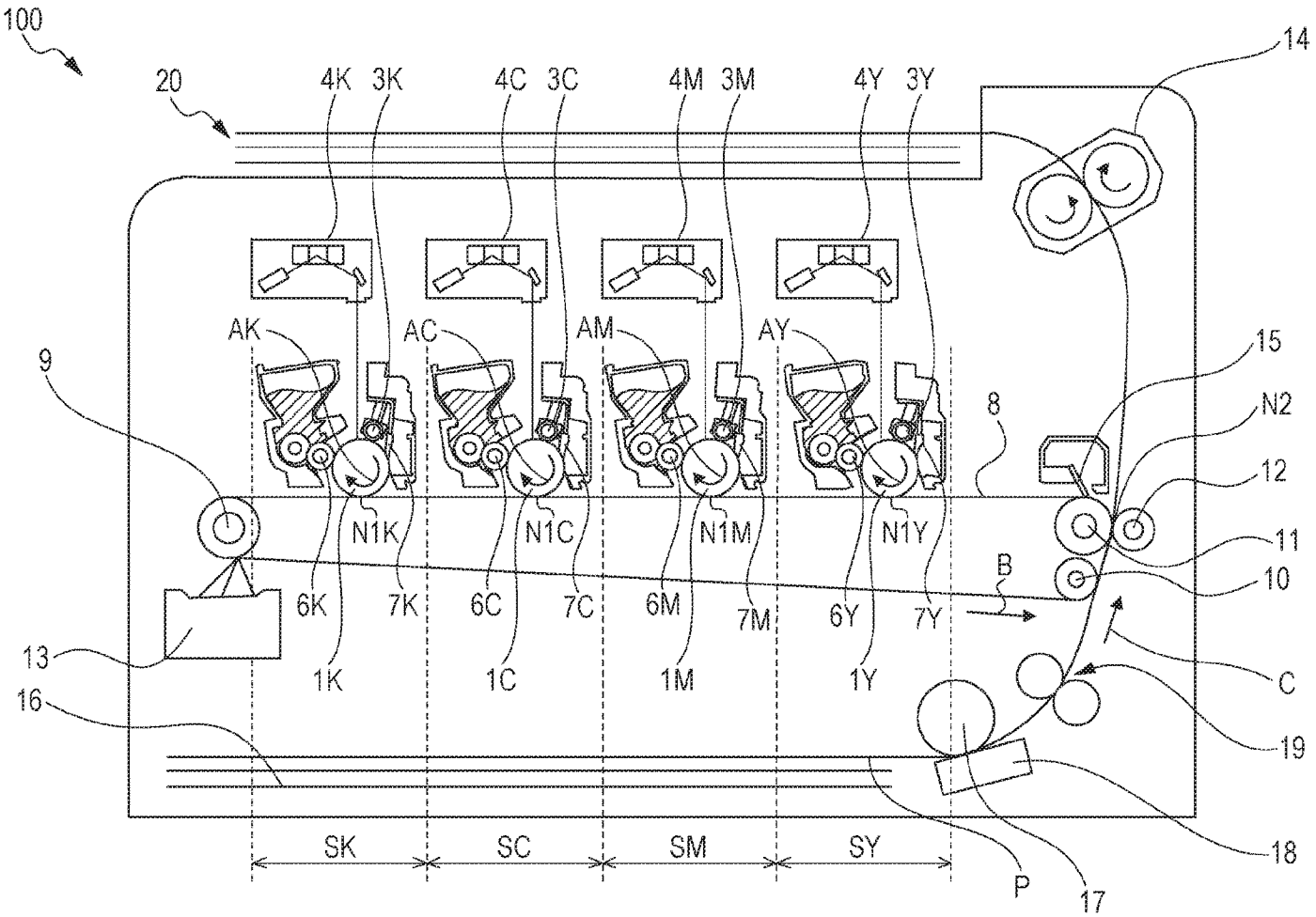
FIG. 11 is a schematic cross-sectional view of an image forming apparatus of Modification 2.

In the present embodiment, the image forming apparatus 100 uses a lower surface exposure system in which the image forming units SY, SM, SC, and SK for forming respective color images are disposed in a plane below the intermediate transfer belt 8 viewed from the direction of gravitational force. However, this is given for mere illustration. As illustrated in. FIG. 11, an image forming apparatus of Modification 2 of the present embodiment in which the image forming units SY, SM, SC, and SK are disposed in a plane above the intermediate transfer belt 8 viewed from the direction of gravitational force can have the same advantages as those of the present embodiment in Modification 2, the distance between the primary transfer portions N1 of the image forming units S is the same as that in the present embodiment. The length of the intermediate transfer belt 8 from the primary transfer portion N1K to the secondary transfer portion N2 in the moving direction of the intermediate transfer belt 8 is 330 mm.

Figure 12A:
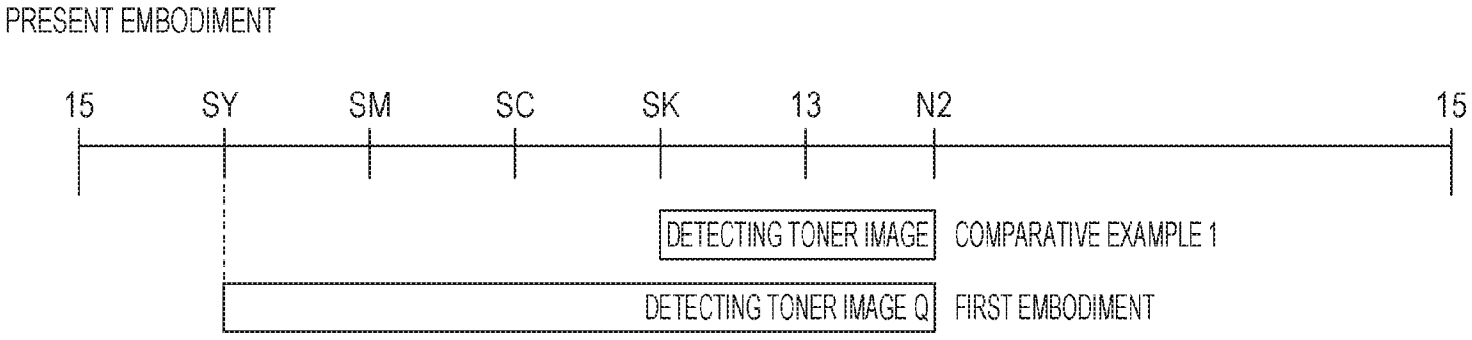
FIG. 12A is a schematic diagram illustrating the positions of the components in the vicinity of the intermediate transfer belt and the maximum lengths of detecting toner images that can be formed in the first embodiment and Comparative Example 1.

FIG. 12A is a schematic diagram illustrating the positions of the components in the vicinity of the intermediate transfer belt 8 and the maximum lengths of detecting toner images that can be formed in the present embodiment and Comparative Example 1. Comparative Example 1 has a configuration in which the control for setting the absolute value of the second potential difference equal to or greater than the absolute value of the first potential difference is not performed when switching the polarity of voltage to be applied from the transfer power source to the secondary transfer roller. In other words, in order to prevent reverse transfer in Comparative Example 1, all the detecting toner images need to finish passing through the primary transfer portion of the lowermost image forming unit in the moving direction of the intermediate transfer belt 8 before the polarity of voltage to be applied from the transfer power source to the secondary transfer roller is switched. In this case, as illustrated in FIG. 12A, the total length of the detecting toner images has to be smaller than the length of the lowermost image forming unit from the primary transfer portion to the secondary transfer portion in the moving direction of the intermediate transfer belt 8.

In contrast, in the present embodiment, there is no need for all the detecting toner images Q to finish passing through the primary transfer portion N1K of the lowermost image forming unit SK in the moving direction of the intermediate transfer belt 8 before the polarity of voltage to be applied from the transfer power source 24 to the secondary transfer roller 12 is switched. Thus, the detecting toner image Q of each color can be transferred in each image forming unit S until the detecting toner image QK transferred from the lowermost image forming unit SK to the intermediate transfer belt 8 reaches the secondary transfer portion N2. Thus, the present embodiment can form a longer detecting toner image Q than that of Comparative Example 1.

Figure 12B:
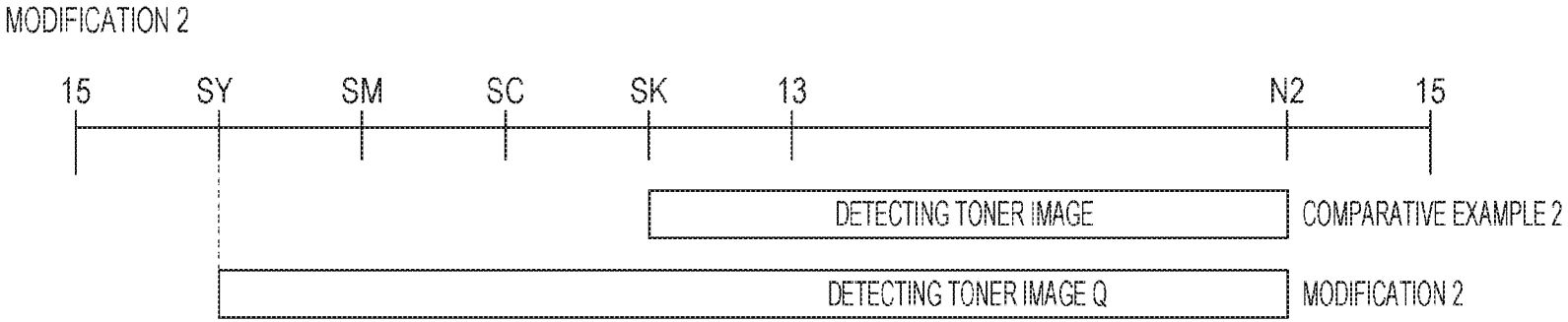
FIG. 12B is a schematic diagram illustrating the positions of the components in the vicinity of the intermediate transfer belt and the maximum length of detecting toner images that can be formed in Modification 2 and Comparative Example 2.

FIG. 12B is a schematic diagram illustrating the positions of the components in the vicinity of the intermediate transfer belt 8 and the maximum length of detecting toner images that can be formed in Modification 2 and Comparative Example 2. The image forming apparatuses of Modification 2 and Comparative Example 2 have a configuration in which the image forming units SY, SM, SC, and SK are disposed in a plane above the intermediate transfer belt 8 viewed from the direction of gravitational force. Comparative Example 2 has a configuration in which all the detecting toner images complete passing through the primary transfer portion of the lowermost image forming unit in the moving direction of the intermediate transfer belt 8 before the polarity of the voltage to be applied from the transfer power source to the secondary transfer roller is switched, as in Comparative Example 1. As illustrated in FIG. 12B, the configuration of the image forming apparatus of Modification 2 can also offer the same advantages as those of the present embodiment.

Second Embodiment

Figure 13:
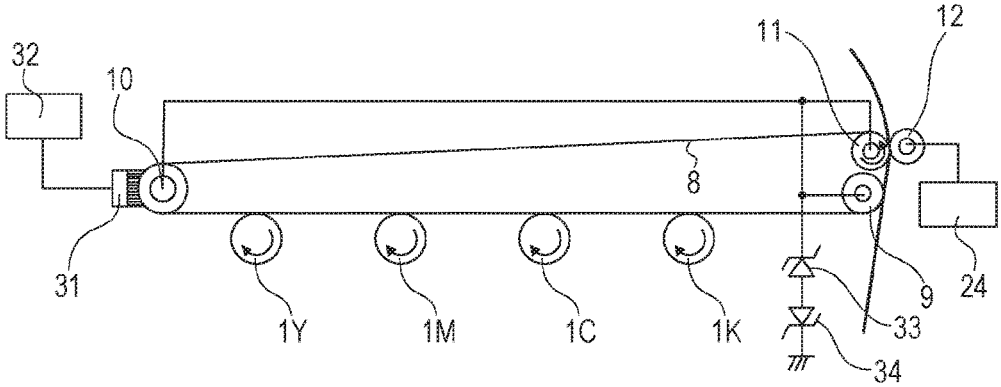
FIG. 13 is a schematic diagram illustrating the connection relationship among the components in contact with the intermediate transfer belt in a second embodiment.

In the first embodiment, the components (the drive roller 9, the stretching roller 10, and the facing roller 11) in contact with the inner circumferential surface of the intermediate transfer belt 8 are connected to the Zener diode 25 in the positive direction. In contrast, in a second embodiment, the components (the drive roller 9, the stretching roller 10, and the facing roller 11) in contact with the inner circumferential surface of the intermediate transfer belt 8 are connected to a Zener diode 33 in the positive direction and a Zener diode 34 in the negative direction, as illustrated in FIG. 13. The configuration of an image forming apparatus 200 according to the present embodiment is the same as the configuration of the first embodiment except that an intermediate cleanerless (ICL) system is used as a recovery unit for recovering toner from the intermediate transfer belt 8 is used and that the Zener diode 33 and the Zener diode 34 are used instead of the Zener diode 25. Therefore, components common to the first embodiment are given the same reference signs as those of the first embodiment, and descriptions thereof will be omitted.

Figure 14:
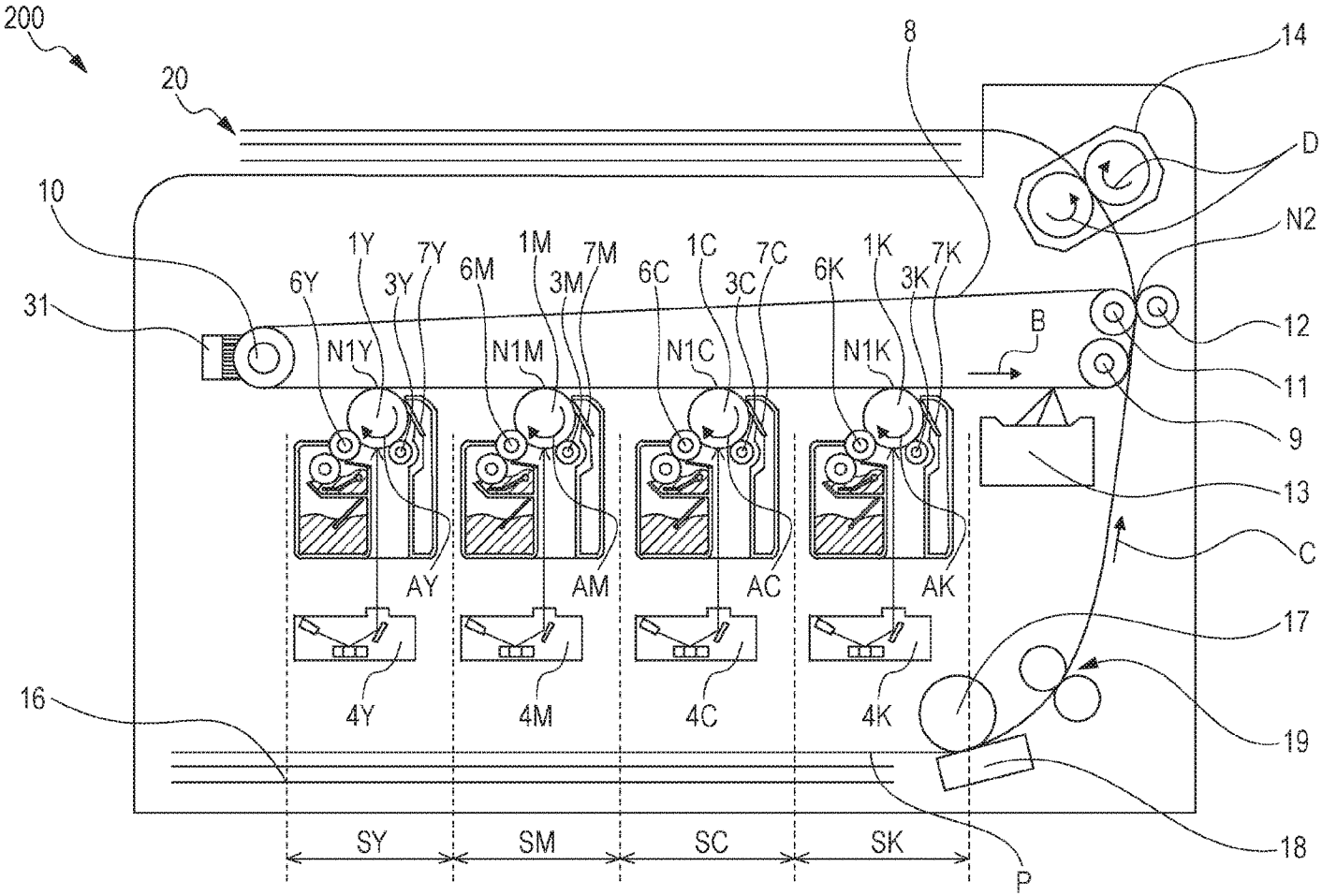
FIG. 14 is a schematic cross-sectional view of an image forming apparatus of the second embodiment.

FIG. 13 is a schematic diagram illustrating the connection relationship among the components in contact with the intermediate transfer belt 8 of the present embodiment. FIG. 14 is a schematic cross-sectional view of the image forming apparatus 200 of the present embodiment. As illustrated in FIG. 14, the image forming apparatus 200 of the present embodiment employs an intermediate cleanerless system having no cleaning unit for recovering toner remaining on the intermediate transfer belt 8 after secondary transfer. The intermediate cleanerless system is hereinafter referred to as an ICL system.

As illustrated in FIG. 13, the ICL system does not have a cleaning blade that is in contact with the intermediate transfer belt 8 but has a conductive brush member 31 in contact with the intermediate transfer belt 8. A blush power source 32 applies a positive voltage to the brush member 31. Toner remaining on the intermediate transfer belt 8 moves together with the intermediate transfer belt 8 and is charged to positive polarity by the brush member 31, to which the positive voltage is applied from the blush power source 32, while passing through a contact portion between the brush member 31 and the intermediate transfer belt 8. The toner charged to positive polarity moves to the photosensitive drum 1 by the force of the electric field directed from the intermediate transfer belt 8 to the photosensitive drum 1 at the primary transfer portion N1 of the image forming unit. S and is recovered by the drum cleaning unit 7. The toner charged by the brush member 31 may be recovered by any one of the image forming units SY, SM, SC, and SK.

The negative-polarity toner remaining on the intermediate transfer belt 8 after the secondary transfer can adhere to the brush member 31 while passing by the brush member 31 to which a positive voltage is applied. In order to remove the toner adhering to the brush member 31, the present embodiment includes the Zener diode 34 in the negative direction in addition to the Zener diode 33 in the positive direction for maintaining the potential of the intermediate transfer belt 8 at the positive breakdown voltage. In other words, the cathode of the Zener diode 34 (a second Zener diode) is connected to the ground, and the anode of the Zener diode 34 is connected to the anode of the Zener diode 33 (a first Zener diode). The cathode of the Zener diode 33 is connected to the components (the drive roller 9, the stretching roller 10, and the facing roller 11) in contact with the inner circumferential surface of the intermediate transfer belt 8. As the Zener diode 33 in the positive direction, a diode with a breakdown voltage of 300 V is used, and as the Zener diode 34 in the negative direction, a diode with a breakdown voltage of 300 V is used, as in the first embodiment.

The operation for removing the negative-polarity toner adhering to the brush member 31 is as follows. First, a positive voltage sufficiently larger than the breakdown voltage of the Zener diode 33 is applied from the transfer power source 24 to the secondary transfer roller 12 to maintain the potential of the intermediate transfer belt 8 at 300 V, which is the breakdown voltage of the Zener diode 33. The output of the blush power source 32 is stopped to bring the potential of the brush member 31 to 0 V, and the negative polarity toner adhering to the brush member 31 is moved to the intermediate transfer belt 8 using the potential difference formed between the brush member 31 and the intermediate transfer belt 8. The toner adhering to the intermediate transfer belt 8 moves together with the intermediate transfer belt 8 to reach the primary transfer portion N1.

At that time, a negative voltage sufficiently larger than the breakdown voltage of the Zener diode 34 is applied from the transfer power source 24 to the secondary transfer roller 12 to maintain the potential of the intermediate transfer belt 8 at −300 V using the Zener diode 34. Furthermore, at the image forming unit S, the potential of the photosensitive drum 1 is decreased to −100 V using the charging roller 3 and the exposing unit 4. As a result, the negative-polarity toner that has moved from the brush member 31 to the intermediate transfer belt 8 adheres to the photosensitive drum 1 at the primary transfer portion N1 by the force of the electric field directed from the intermediate transfer belt 8 to the photosensitive drum 1. Afterwards, the negative-polarity toner adhering to the photosensitive drum 1 is recovered by the drum cleaning unit 7.

Image-Density Adjusting Operation

Figure 15A:
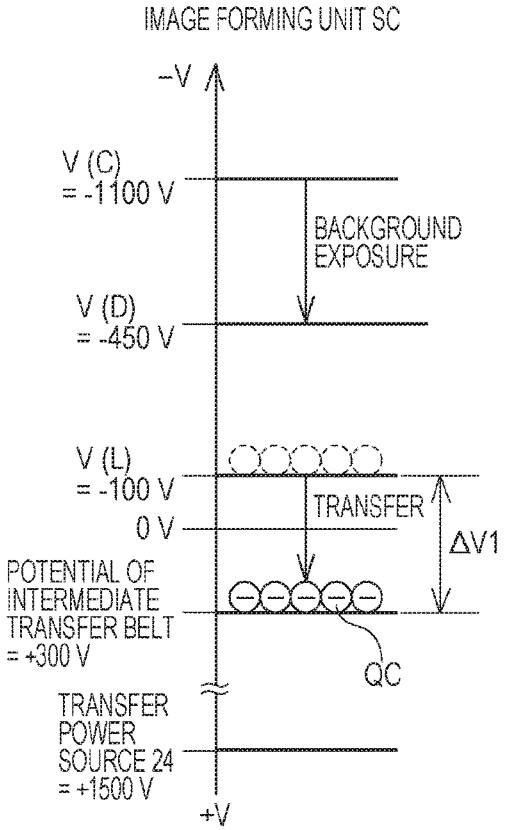
FIG. 15A is a schematic diagram illustrating the potential relationship at the operation for adjusting the image density in the second embodiment.
Figure 15B:
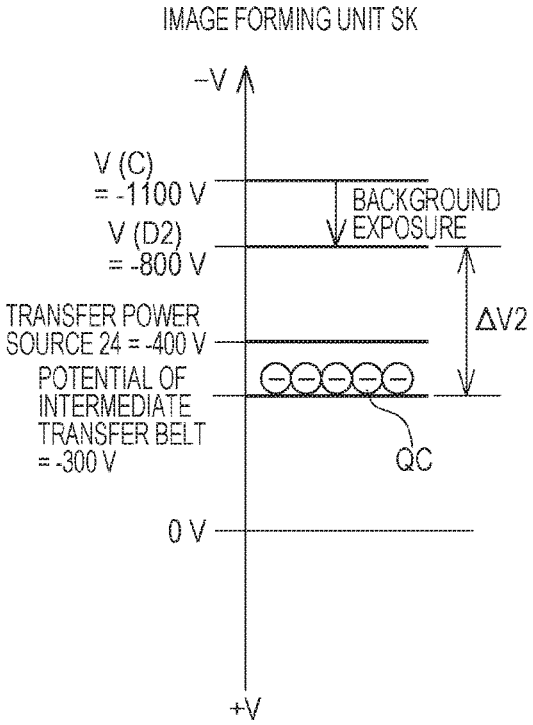
FIG. 15B is a schematic diagram illustrating the potential relationship at the operation for adjusting the image density in the second embodiment.

An image-density adjusting operation with the configuration of the present embodiment will be described using the image forming unit SC and the image forming unit SK, as in the first embodiment. FIG. 15A is a schematic diagram illustrating the potential relationship when the detecting toner image QC is transferred to the intermediate transfer belt 8. At that time, the absolute value of the first potential difference ΔV1 for transferring the detecting toner image QC to the intermediate transfer belt 8 is 400 V. FIG. 15B is a schematic diagram illustrating the potential relationship when the polarity of the voltage to be applied from the transfer power source 24 to the secondary transfer roller 12 is switched. In the present embodiment, the charge potential V(C) formed on each photosensitive drum 1 by each charging roller 3 in the process of forming an electrostatic latent image on the photosensitive drum 1 of each image forming unit S is set to −1,100 V.

In the first embodiment, when the polarity of the voltage to be applied from the transfer power source 24 to the secondary transfer roller 12 is switched to negative polarity, the potential of the intermediate transfer belt 8 is substantially 0 V. However, in the present embodiment, the potential of the intermediate transfer belt 8 is maintained at −300 V (second potential). Therefore, in order to prevent the detecting toner image QC from being reversely transferred to the photosensitive drum 1K, the present embodiment controls the amount of exposure from the exposing unit 4K to the photosensitive drum 1K using the controller circuit 23 to bring the background electrical potential V(D2) of the photosensitive drum 1K to −800 V. Thus, the absolute value of the second potential difference ΔV2 becomes equal to or greater than the absolute value of the first potential difference ΔV1, offering the same advantages as in the first embodiment.

Figure 16:
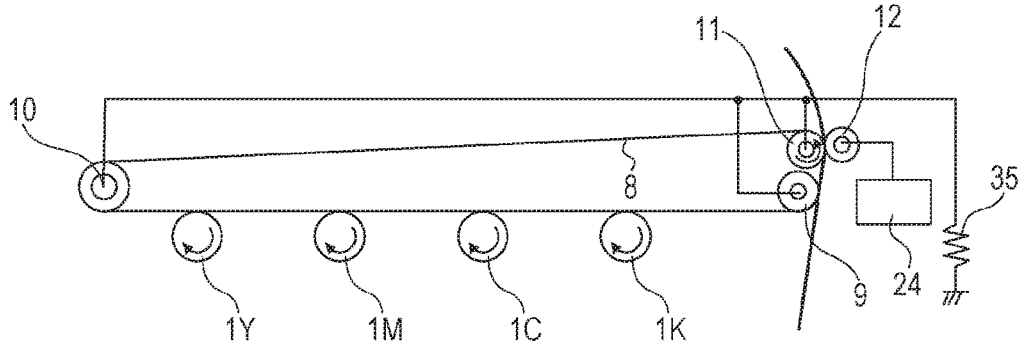
FIG. 16 is a schematic diagram illustrating the connection relationship among the components in contact with the intermediate transfer belt in Modification 3.

In the present embodiment, the Zener diode 33 in the positive direction and the Zener diode 34 in the negative direction are used to maintain the potential of the intermediate transfer belt 8 negative. Alternatively, a resistive element 35 may be used instead of the constant voltage element, as in Modification 3 of FIG. 16, provided that the potential of the intermediate transfer belt 8 can be maintained at negative polarity by applying a negative voltage from the transfer power source 24 to the secondary transfer roller 12. As another alternative, a constant voltage element, such as a varistor, may be used to have the same advantages as in the present embodiment.

Third Embodiment

Figure 17A:
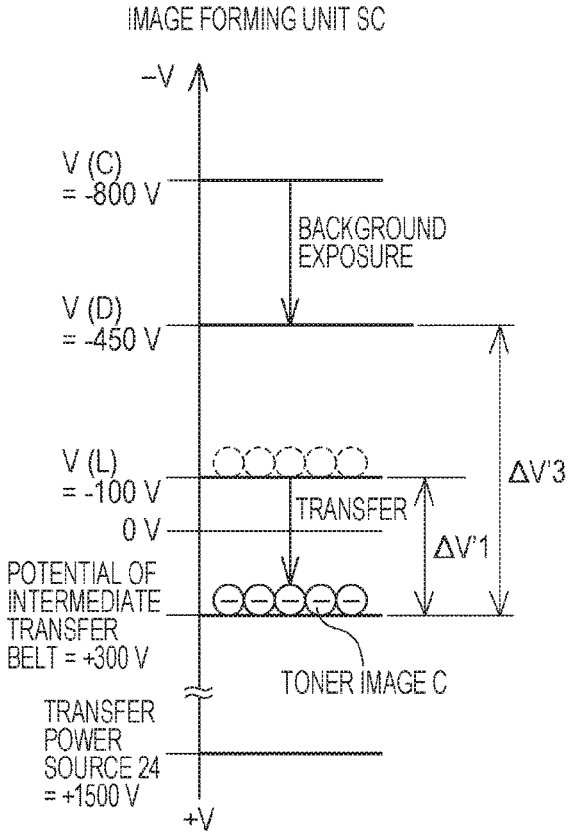
FIG. 17A is a schematic diagram illustrating the potential relationship at normal image formation in a third embodiment.
Figure 17B:
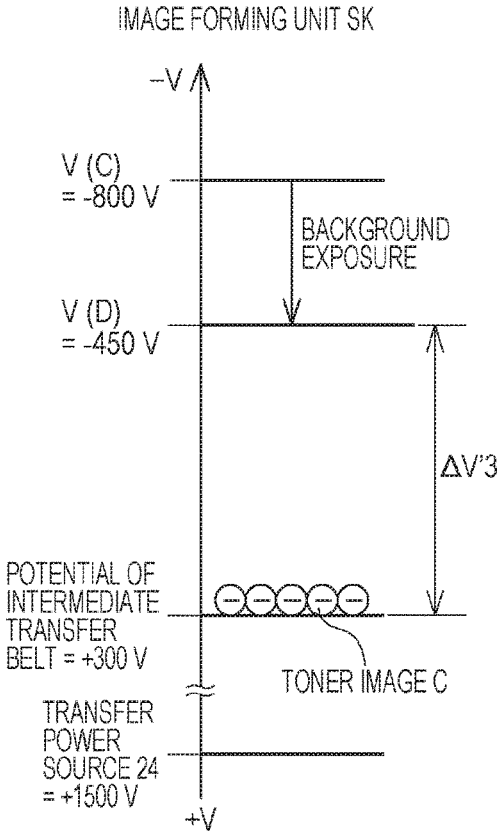
FIG. 17B is a schematic diagram illustrating the potential relationship at normal image formation in the third embodiment.

In the first and second embodiments, the absolute value of the second potential difference ΔV2 is made equal to or greater than the absolute value of the first potential difference ΔV1 by control of the controller circuit 23 serving as a control unit. In contrast, a third embodiment has the following configuration, as illustrated in FIGS. 17A and 17B. Specifically, in the third embodiment, the absolute value of the second potential difference ΔV2 is equal to the absolute value of a third potential difference ΔV3 between the background electrical potential V(D) of the photosensitive drum 1 and the potential of the intermediate transfer belt 8 when the detecting toner image Q is transferred to the intermediate transfer belt 8.

The configuration of the image forming apparatus of the present embodiment is the same as the configuration of the first embodiment except that the absolute value of the second potential difference ΔV2 is made equal to the absolute value of the third potential difference ΔV3. For that reason, components common to the first embodiment are given the same reference signs as those of the first embodiment, and descriptions of commonalities between the first and third embodiment will be omitted. The present embodiment will also be described using the image forming unit SC and the image forming unit SF, as in the first embodiment.

Reverse transfer can be reduced or eliminated when the absolute value of the second potential difference ΔV2 is made equal to or greater than the absolute value of the first potential difference ΔV1. However, the amount of reversely transferred toner changes a little depending on the value of the second potential difference ΔV2, as illustrated in FIG. 9. For more accurate adjustment of the image density, the amount of toner of the detecting toner image Q, which changes because of reverse transfer at the image-density adjusting operation, may be close to the amount of toner of a toner image C, which changes because of reverse transfer at a normal image forming operation. In other words, the image density can be adjusted more accurately by bringing the amount of change of the toner of the detecting toner image QC, which is reversely transferred to the photosensitive drum 1K because of the second potential difference ΔV2, close to the amount of change of the toner of the toner image C, which is reversely transferred to the photosensitive drum 1K at the normal image forming operation. Referring to FIGS. 17A and 7B, the potential relationship when the transferred toner image C coming from the image forming unit SC passes through the image forming unit SK will be described.

FIG. 17A is a schematic diagram illustrating the potential relationship of the image forming unit SC when the toner image C is transferred from the photosensitive drum 1C to the intermediate transfer belt 8. At that time, a background electrical potential V(D) of −450 V is formed on the photosensitive drum 1C by the charging roller 3C and the exposing unit 4C, and the absolute value of the potential difference ΔV'3 between the background electrical potential V(D) and the potential of the intermediate transfer belt 8 is 750 V. The absolute value of the potential difference ΔV'1 between the latent-image electric potential V(L) and the potential of the intermediate transfer belt 8 is 400 V.

FIG. 17B is a schematic diagram illustrating the potential relationship when the toner image C transferred from the photosensitive drum 1C to the intermediate transfer belt 8 passes through the primary transfer portion N1K. As illustrated in FIG. 17B, at the normal image formation, there is no need to switch the polarity of the voltage to be output from the transfer power source 24, and the potential of the intermediate transfer belt 8 does not change, so that the potential of the intermediate transfer belt 8 is kept at 300 V. Therefore, the potential difference between the background electrical potential V(D) of the photosensitive drum 2K and the potential of the intermediate transfer belt 8 when the toner image C passes through the primary transfer portion NIK is equal to ΔV'3 of the image forming unit SC when the toner image C is transferred to the intermediate transfer belt 8. In other words, the absolute value of the potential difference between the background electrical potential V(D) of the photosensitive drum 1 and the potential of intermediate transfer belt 8 does not change before and after the transfer of the toner image C, constantly at ΔV'3 −750 V in the present embodiment.

Figure 18A:
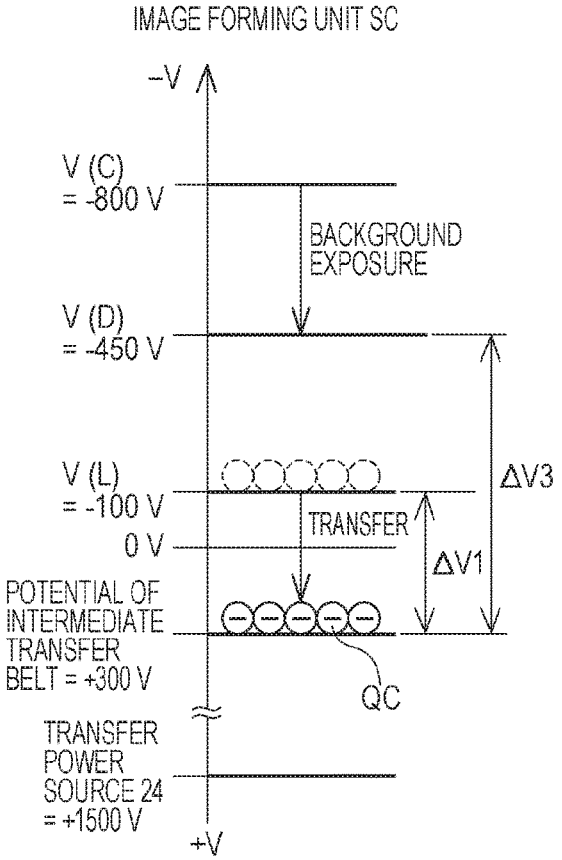
FIG. 18A is a schematic diagram illustrating the potential relationship at the operation for adjusting the image density in the third embodiment.

Next, referring to FIGS. 18A and 18B, the potential relationship when the transferred detecting toner image QC coming from image forming unit SC passes through the image forming unit SK in the present embodiment will be described. FIG. 18A is a schematic diagram illustrating die potential relationship when the detecting toner image QC is transferred to the intermediate transfer belt 8. At that time, a background electrical potential V(D) of −450 V is formed on the photosensitive drum 1C by the charging roller 3C and the exposing unit 4C. The absolute value of a third potential difference ΔV3 between the background electrical potential V(D) and the potential of the intermediate transfer belt 8 is 750 V.

Figure 18B:
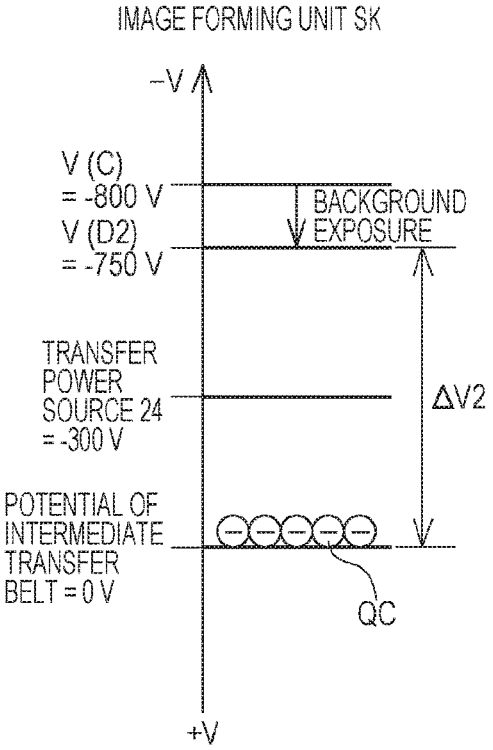
FIG. 18B is a schematic diagram illustrating the potential relationship at the operation for adjusting the image density in the third embodiment.

FIG. 18B is a schematic diagram illustrating the potential relationship when the polarity of voltage to be applied from the transfer power source 24 to the secondary transfer roller 12 is switched when the detecting toner image QC transferred to the intermediate transfer belt 8 passes through the primary transfer portion N1K. In the present embodiment, as illustrated in FIG. 18B, the background electrical potential V(D2) of the photosensitive drum 1K when the detecting toner image QC passes through the primary transfer portion N1K is set at −750 V. In other words, the background electrical potential V(D2) of the photosensitive drum 1K is changed to −750 V by switching the polarity of the voltage to be output from the transfer power source 24 and decreasing the amount of light of background exposure of the photosensitive drum 1K from the exposing unit 4K. As a result, the absolute value of the second potential difference ΔV2 becomes equal to the absolute value of the third potential difference ΔV3 before the detecting toner image QC is transferred to the intermediate transfer belt 8.

The amount of change of the toner when the detecting toner image QC passes through the primary transfer portion N1K becomes substantially equal to that at normal image formation by making the absolute value of the second potential difference ΔV2 equal to the absolute value of the third potential difference ΔV3 after the polarity of the voltage to be output from the transfer power source 24 is switched. Adjusting the image density by bringing the amount of change of the toner of the detecting toner image QC at the image-density adjusting operation close to that at the normal image formation provides the same advantages as in the first embodiment and allowing more accurate adjustment of the image density.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2016-109283 filed May 31, 2016, which is hereby incorporated by reference herein in its entirety.

What is claimed is:

1. An image forming apparatus comprising:

a first image-bearing member configured to bear a toner image;

a first exposing unit configured to expose the first image-bearing member to form an electrostatic latent image;

a first developing unit configured to develop the electrostatic latent image formed on the first image-bearing member with toner to form a toner image;

a second image-bearing member configured to bear the toner image;

a charging unit configured to uniformly charge a surface of the second image-bearing member;

a charging power source configured to apply voltage to the charging unit;

an endless, rotatable intermediate transfer belt in contact with the first image-bearing member and the second image-bearing member;

a secondary transfer member configured to secondarily transfer the toner image that is primarily transferred from the first image-bearing member and the second image-bearing member to the intermediate transfer belt to a transfer material;

a power source configured to apply voltage to the secondary transfer member, wherein the power source forms a first potential on the intermediate transfer belt by applying a voltage of a predetermined polarity to the secondary transfer member and forms a second potential different from the first potential on the intermediate transfer belt by applying a voltage having a polarity opposite to the voltage of the predetermined polarity to the secondary transfer member;

a detecting unit configured to detect a first detecting toner image transferred from the first image-bearing member to the intermediate transfer belt, the first detecting toner image on the first image-bearing member being formed by using the first developing unit to develop an electrostatic latent image of the first detecting toner image after the first exposing unit exposes a position corresponding to the electrostatic latent image to form a latent-image electric potential on the first image-bearing member, wherein the detecting unit is disposed upstream from the secondary transfer member and downstream from the first image-bearing member and the second image-bearing member in a moving direction of the intermediate transfer belt, and wherein the second image-bearing member is disposed upstream from the detecting unit and downstream from the first image-bearing member; and a control unit configured to control the charging power source to form a potential of the second image-bearing member in such a manner that, in a case where a voltage having a polarity opposite to the voltage of the predetermined polarity is applied to the secondary transfer member while the first detecting toner image transferred to the intermediate transfer belt due to a first potential difference between the latent-image electric potential and the first potential is passing through a position at which the second image-bearing member and the intermediate transfer belt come into contact with each other, an absolute value of a second potential difference between the second potential and the potential of the second image-bearing member becomes equal to or greater than an absolute value of the first potential difference.

2. The image forming apparatus according to claim 1, wherein a second detecting toner image is transferred from the second image-bearing member to the intermediate transfer belt on a downstream side from the first detecting toner image in a moving direction of the intermediate transfer belt, and wherein the power source applies a voltage having a polarity opposite to the predetermined polarity to the secondary transfer member at a timing after the first detecting toner image and the second detecting toner image are transferred to the intermediate transfer belt and before the second detecting toner image reaches a position where the secondary transfer member and the intermediate transfer belt come into contact with each other.

3. The image forming apparatus according to claim 1, wherein the control unit controls the charging power source to form the potential of the second image-bearing member simultaneously with or after application of a voltage having a polarity opposite to the predetermined polarity to the secondary transfer member from the power source.

4. The image forming apparatus according to claim 1, wherein the control unit controls the first exposing unit to expose the first image-bearing member to form a background electrical potential at a position where the electrostatic latent image of the first detecting toner image is not to be formed and controls the charging power source in such a manner that, in a case where a voltage having a polarity opposite to the predetermined polarity is applied to the secondary transfer member while the first detecting toner image is passing through a position where the second image-bearing member and the intermediate transfer belt come into contact with each other, the absolute value of the second potential difference becomes equal to an absolute value of a third potential difference between the background electrical potential and the first potential.

5. The image forming apparatus according to claim 1, further comprising:

a second developing unit that can come into or out of contact with the second image-bearing member and configured to develop an electrostatic latent image formed on the second image-bearing member with toner to form a toner image, wherein the control unit separates the second developing unit from the second image-bearing member before controlling the charging power source to form the potential of the second image-bearing member.

6. The image forming apparatus according to claim 1, further comprising:

a second developing unit configured to develop an electrostatic latent image formed on the second image-bearing member with toner to form a toner image; and a developing power source configured to form a potential on the second developing unit by applying voltage, wherein the control unit controls the charging power source to form the potential of the second image-bearing member to make the absolute value of the second potential difference equal to or greater than the absolute value of the first potential difference, and thereafter controls the developing power source to change the potential of the second image-bearing member to make an absolute value of a potential difference between the potential of the second image-bearing member and the potential of the second developing unit small.

7. The image forming apparatus according to claim 1, further comprising:

a stretching member configured to stretch the intermediate transfer belt; and a constant voltage element connected to the stretching member and capable of keeping a predetermined voltage by a current flowing therethrough.

8. The image forming apparatus according to claim 7, wherein the constant voltage element comprises a Zener diode, wherein the Zener diode is grounded at an anode and is connected to the stretching member at a cathode.

9. The image forming apparatus according to claim 7, wherein the constant voltage element comprises a first Zener diode and a second Zener diode, the first Zener diode being connected to the stretching member at a cathode and connected to an anode of the second Zener diode at an anode, the second Zener diode being grounded at a cathode.

10. The image forming apparatus according to claim 1, further comprising:

a brush member in contact with an outer circumferential surface of the intermediate transfer belt; and a blush power source configured to apply voltage to the brush member, wherein toner remaining on the intermediate transfer belt after the toner image is secondarily transferred from the intermediate transfer belt to the transfer material moves together with the intermediate transfer belt, is charged while passing through a position where the brush member to which the voltage of the predetermined polarity is applied from the blush power source and the intermediate transfer belt come into contact with each other, and moves from the intermediate transfer belt to the first image-bearing member or the second image-bearing member at a position where the first image-bearing member and the intermediate transfer belt come into contact with each other or the position where the second image-bearing member and the intermediate transfer belt come into contact with each other.

11. The image forming apparatus according to claim 1, wherein the first detecting toner image is shorter in the moving direction of the intermediate transfer belt than a length of the intermediate transfer belt from a position where the first image-hearing member and the intermediate transfer belt come into contact with each other to the position where the second image-bearing member and the intermediate transfer belt come into contact with each other.

12. An image forming apparatus comprising:

a first image-bearing member configured to bear a toner image;

a first exposing unit configured to expose the first image-bearing member to form an electrostatic latent image;

a first developing unit configured to develop the electrostatic latent image formed on the first image-bearing member with toner to form a toner image;

a second image-bearing member configured to bear the toner image;

a charging unit configured to uniformly charge a surface of the second image-bearing member;

a second exposing unit configured to expose the uniformly charged second image-bearing member;

an endless, rotatable intermediate transfer belt in contact with the first image-bearing member and the second image-bearing member;

a secondary transfer member configured to secondarily transfer the toner image that is primarily transferred from the first image-bearing member and the second image-bearing member to the intermediate transfer belt to a transfer material;

a power source configured to apply voltage to the secondary transfer member, wherein the power source forms a first potential on the intermediate transfer belt by applying a voltage of a predetermined polarity to the secondary transfer member and forms a second potential different from the first potential on the intermediate transfer belt by applying a voltage having a polarity opposite to the voltage of the predetermined polarity to the secondary transfer member;

a detecting unit configured to detect a first detecting toner image transferred from the first image-bearing member to the intermediate transfer belt, the first detecting toner image on the first image-bearing member being formed by using the first developing unit to develop an electrostatic latent image of the first detecting toner image after the first exposing unit exposes a position corresponding to the electrostatic latent image to form a latent-image electric potential on the first image-bearing member, wherein the detecting unit is disposed upstream from the secondary transfer member and downstream from the first image-bearing member and the second image-bearing member in a moving direction of the intermediate transfer belt, and wherein the second image-bearing member is disposed upstream from the detecting unit and downstream from the first image-bearing member; and a control unit configured to control the second exposing unit to form a potential of the second image-bearing member in such a manner that, in a case where a voltage having a polarity opposite to the voltage of the predetermined polarity is applied to the secondary transfer member while the first detecting toner image transferred to the intermediate transfer belt due to a first potential difference between the latent-image electric potential and the first potential is passing through a position at which the second image-bearing member and the intermediate transfer belt come into contact with each other, an absolute value of a second potential difference between the second potential and the potential of the second image-bearing member becomes equal to or greater than an absolute value of the first potential difference.

13. The image forming apparatus according to claim 12, wherein a second detecting toner image is transferred from the second image-bearing member to the intermediate transfer belt on a downstream side from the first detecting toner image in a moving direction of the intermediate transfer belt, and wherein the power source applies a voltage having a polarity opposite to the predetermined polarity to the secondary transfer member at a timing after the first detecting toner image and the second detecting toner image are transferred to the intermediate transfer belt and before the second detecting toner image reaches a position where the secondary transfer member and the intermediate transfer belt come into contact with each other.

14. The image forming apparatus according to claim 12, wherein the control unit controls the second exposing unit to form the potential of the second image-bearing member simultaneously with or after application of a voltage having a polarity opposite to the predetermined polarity to the secondary transfer member from the power source.

15. The image forming apparatus according to claim 12, wherein the control unit controls the first exposing unit to expose the first image-bearing member to form a background electrical potential at a position where the electrostatic latent image of the first detecting toner image is not to be formed and controls the second exposing unit in such a manner that, in a case where a voltage having a polarity opposite to the predetermined polarity is applied to the secondary transfer member while the first detecting toner image is passing through a position where the second image-bearing member and the intermediate transfer belt come into contact with each other, the absolute value of the second potential difference becomes equal to an absolute value of a third potential difference between the background electrical potential and the first potential.

16. The image forming apparatus according to claim 12, further comprising:

a second developing unit that can come into or out of contact with the second image-bearing member and configured to develop an electrostatic latent image formed on the second image-bearing member with toner to form a toner image, wherein the control unit separates the second developing unit from the second image-bearing member before controlling the second exposing unit to form the potential of the second image-bearing member.

17. The image forming apparatus according to claim 12, further comprising:

a second developing unit configured to develop an electrostatic latent image formed on the second image-bearing member with toner to form a toner image; and a developing power source configured to form a potential on the second developing unit by applying voltage, wherein the control unit controls the second exposing unit to form the potential of the second image-bearing member to make the absolute value of the second potential difference equal to or greater than the absolute value of the first potential difference, and thereafter controls the developing power source to change the potential of the second image-bearing member to make an absolute value of a potential difference between the potential of the second image-bearing member and the potential of the second developing unit small.

18. The image forming apparatus according to claim 12, further comprising:

a stretching member configured to stretch the intermediate transfer belt; and a constant voltage element connected to the stretching member and capable of keeping a predetermined voltage by a current flowing therethrough.

19. The image forming apparatus according to claim 18, wherein the constant voltage element comprises a Zener diode, wherein the Zener diode is grounded at an anode and is connected to the stretching member at a cathode.

20. The image forming apparatus according to claim 18, wherein the constant voltage element comprises a first Zener diode and a second Zener diode, the first Zener diode being connected to the stretching member at a cathode and connected to an anode of the second Zener diode at an anode, the second Zener diode being grounded at a cathode.

21. The image forming apparatus according to claim 12, further comprising:

a brush member in contact with an outer circumferential surface of the intermediate transfer belt; and a blush power source configured to apply voltage to the brush member, wherein toner remaining on the intermediate transfer belt after the toner image is secondarily transferred from the intermediate transfer belt to the transfer material moves together with the intermediate transfer belt, is charged while passing through a position where the brush member to which the voltage of the predetermined polarity is applied from the blush power source and the intermediate transfer belt come into contact with each other, and moves from the intermediate transfer belt to the first image-bearing member or the second image-bearing member at a position where the first image-bearing member and the intermediate transfer belt come into contact with each other or the position where the second image-bearing member and the intermediate transfer belt come into contact with each other.

22. The image forming apparatus according to claim 12, wherein the first detecting toner image is shorter in the moving direction of the intermediate transfer belt than a length of the intermediate transfer belt from a position where the first image-bearing member and the intermediate transfer belt come into contact with each other to the position where the second image-bearing member and the intermediate transfer belt come into contact with each other.

* * * * *